US009266297B1

(12) United States Patent
Flaming et al.

(10) Patent No.: US 9,266,297 B1
(45) Date of Patent: Feb. 23, 2016

(54) PLEAT FORMING APPARATUSES AND/OR EQUIPMENT AND RELATED METHODS

(75) Inventors: Max Flaming, Fresno, CA (US); Michael Reitz, Visalia, CA (US)

(73) Assignee: Maxco Supply, Inc., Parlier, CA (US)

( * ) Notice: Subject to any disclaimer, the term of this patent is extended or adjusted under 35 U.S.C. 154(b) by 664 days.

(21) Appl. No.: 13/554,841

(22) Filed: Jul. 20, 2012

Related U.S. Application Data

(60) Provisional application No. 61/510,030, filed on Jul. 20, 2011.

(51) Int. Cl.

| | |
|---|---|
| ***B31B 3/28*** | (2006.01) |
| ***B31B 3/30*** | (2006.01) |
| ***B31B 3/50*** | (2006.01) |
| ***B65D 5/30*** | (2006.01) |
| ***B65D 71/58*** | (2006.01) |
| ***B65D 5/48*** | (2006.01) |
| ***B31B 1/30*** | (2006.01) |
| ***B31B 1/50*** | (2006.01) |

(52) U.S. Cl.
CPC .... *B31B 1/30* (2013.01); *B31B 1/50* (2013.01)

(58) Field of Classification Search
CPC ..... B65D 5/30; B65D 71/0022; B65D 2571/0037; B65D 2571/00339; B65D 5/48002; B31B 3/02; B31B 3/26; B31B 3/28; B31B 3/30; B31B 3/50; B31B 3/72
USPC ..... 493/162, 90, 912, 448, 463; 53/456, 53/564
See application file for complete search history.

(56) References Cited

U.S. PATENT DOCUMENTS

| | | | | |
|---|---|---|---|---|
| 2,890,044 | A * | 6/1959 | Wisdom | 493/413 |
| 2,898,594 | A * | 8/1959 | Levinstein | 227/65 |
| 4,201,119 | A * | 5/1980 | Wolf | 493/457 |
| 4,425,111 | A * | 1/1984 | Chazelas | 493/438 |
| 5,853,360 | A * | 12/1998 | Jeffrey et al. | 493/178 |
| 2009/0272790 | A1 * | 11/2009 | Weissbrod | 229/101 |
| 2012/0090270 | A1 * | 4/2012 | Flaming et al. | 53/396 |

* cited by examiner

*Primary Examiner* — Andrew M Tecco
*Assistant Examiner* — Praachi M Pathak
(74) *Attorney, Agent, or Firm* — Andrew D. Fortney; Central California IP Group, P.C.

(57) ABSTRACT

Apparatuses and/or equipment that automatically form containers with a reinforced bottom panel (pleats), methods of forming a container with a reinforced bottom panel, and methods of manufacturing an apparatus and/or equipment for making a container with a reinforced bottom panel are disclosed. The pleat(s) provide extra strength to the bottom panel of the container, thereby reducing or eliminating bottom sag. The apparatus and/or equipment is advantageously capable of automatically forming a container with a bottom panel having one or more pleats, while avoiding (1) damage to the containers and/or container blanks being folded, and (2) obstructions or instability in the containers that may result from inadvertent folding of the parts, pleats, flaps, and/or panels in the wrong or an inconsistent direction during the manufacturing process.

20 Claims, 15 Drawing Sheets

PLEAT FORMING APPARATUSES AND/OR EQUIPMENT AND RELATED METHODS

RELATED APPLICATIONS

This application claims the benefit of U.S. Provisional Patent Application No. 61/510,030 filed on Jul. 20, 2011, and may be related to co-pending U.S. patent application Ser. No. 13/275,137, filed on Oct. 17, 2011, each of which is incorporated herein by reference in its entirety.

FIELD OF THE INVENTION

The present invention generally relates to the field of container manufacturing equipment. More specifically, embodiments of the present invention pertain to apparatuses and/or equipment that form containers with a reinforced bottom panel, for example, containers with reinforced bottom panels having pleats, folds, or ribs that add strength to the bottom panels of the containers, thereby reducing or eliminating bottom sag, as described in U.S. patent application Ser. No. 13/275,137, filed on Oct. 17, 2011. Embodiments of the present invention also pertain to methods of forming containers with a reinforced bottom panel, and methods of manufacturing apparatuses and/or equipment for forming containers with a reinforced bottom panel.

DISCUSSION OF THE BACKGROUND

Certain containers, such as boxes made from corrugated packaging, can be affected by "bottom sag." Bottom sag occurs when the weight of the product inside the box causes the bottom panel of the container to take on a convex, bowed-out shape, rather than staying flat or straight. This happens to some degree in all containers made from corrugated paper, cardboard, paperboard and combinations thereof, but is especially pronounced when the containers containing the product are stored for relatively long periods of time in a high humidity environment (e.g., a refrigerated room or other cooled storage environment, outdoors in areas with relatively high humidity, etc.).

This "Background" section is provided for background information only. The statements in this "Background" are not an admission that the subject matter disclosed in this "Background" section constitutes prior art to the present disclosure, and no part of this "Background" section may be used as an admission that any part of this application, including this "Background" section, constitutes prior art to the present disclosure.

SUMMARY OF INVENTION

The present invention relates to apparatuses and/or equipment for manufacturing containers (boxes) with a reinforced bottom panel (e.g., a container having a pleat, fold, or rib in the bottom panel). The pleat, fold, or rib (hereinafter, "pleat") provides extra strength to the bottom panel, thereby helping to reduce or eliminate bottom sag in the container. For example, the container 100 shown in FIG. 1 includes a pleat that typically runs the length of the container 100. Each of the ends 110 and 112 of the container 100 have a slit 116 cut therein, and the pleat 114 is inserted into the slits 116. The slits 116 capture the pleat 114 and help keep the pleat 114 from unfolding. Glue or another type of adhesive (e.g., an adhesive tape or epoxy, etc.) may be added between the folds of the pleat 114 to help hold the pleat 114 together and optionally add reinforcement to the bottom panel 120 of the container 100. Suitable containers for use with embodiments of the present invention are described in detail in co-pending U.S. patent application Ser. No. 13/275,137, filed on Oct. 17, 2011, which is incorporated herein by reference in its entirety. A first aspect of the present invention concerns an apparatus for forming a container with a reinforced bottom panel.

In general, the apparatus comprises (1) a pleat forming station including (a) at least one breaker bar, each breaker bar configured to form a first fold in a container blank, (b) at least one pair of score breakers, each score breaker configured to form a second fold in the container blank in a direction opposite to the first fold, and wherein the pair(s) of score breakers are configured to form one or more pleats from portions of the container blank between the second folds, and (c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s); (2) a clutch and feed wheel section comprising a drive mechanism comprising one or more pusher arms, the pusher arms configured to apply pressure to the pleat(s) to move the container blank away from the platform; and (3) a mandrel station comprising a mandrel configured to mate the pleat(s) with one or more slits in each of a pair of opposing end panels and/or place the pleat(s) into the slit(s).

A second aspect of the present invention concerns a method of forming a container with a reinforced bottom panel. The method generally comprises (a) centering a first score line on or in a container blank over a breaker bar, (b) moving a pair of score breakers on or over a second pair of score lines, (c) moving the breaker bar to contact the first score line and bend the container blank to form at least one first fold, (d) moving the breaker bar away from the container blank and moving the score breakers downward and/or toward the first fold(s), until the score breakers form second folds and contact the first fold(s) to form one or more pleats in the container blank, (e) moving the score breakers away from the container blank, (f) moving the container blank into alignment with a mandrel, (g) moving the mandrel toward the container blank, such that (i) the mandrel and/or two opposing end panels on the mandrel contact the container blank, and (ii) the pleat(s) are in one or more slit(s) in each end panel, and (h) folding sidewalls and/or flaps in the container blank approximately perpendicular to and/or around the end panels, thereby forming a container from the container blank and the end panels.

A third aspect of the present invention concerns method of manufacturing a pleat forming apparatus for forming a container with a reinforced bottom panel. The method of manufacturing the apparatus generally comprises (1) constructing a pleat forming station by operably mounting at least one breaker bar and at least one pair of score breakers relative to a platform configured to receive and/or support a container blank having a first score line and a second pair of score lines, the breaker bar(s) and the pair(s) of score breakers configured to form one or more pleats in the container blank; (2) constructing a clutch and feed wheel section by operably mounting a drive mechanism to a drive support frame on or near the platform, the drive mechanism comprising one or more pusher arms configured to apply pressure to the pleat(s) and move the container blank away from the platform; and (3) constructing a mandrel station by assembling a mandrel by operably attaching a mandrel alignment mechanism to a mandrel support frame downstream of the platform and/or the drive mechanism, the mandrel configured to place the pleat(s)

into one or more slits in a pair of opposing end panels and fold the container blank to form the container.

The present invention advantageously provides a mechanical apparatus and/or equipment that automatically form containers with a reinforced bottom panel, such as the container 100 shown in FIG. 1, thereby efficiently and cost-effectively providing such containers. For example, the present invention advantageously provides a mechanical apparatus and/or mechanical equipment that is capable of automatically forming containers (e.g., containers such as bliss-type boxes or trays) having one or more pleats that run the length of the container that reinforce the bottom panel of the container, thereby avoiding (1) damage to the containers and/or container blanks or wraps being folded, and (2) obstructions or instability in the containers that may result from inadvertent folding of the parts, pleats, flaps, and/or panels in the wrong (or an inconsistent) direction during the folding process. The present apparatuses and/or equipment are designed to be easily adaptable to different types of containers that may be constructed with different sizes and/or numbers of pleats.

These and other advantages of the present invention will become readily apparent from the detailed description of various embodiments below.

DETAILED DESCRIPTION

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "containers," "boxes" and "trays" are generally used interchangeably herein, and are generally given their art-recognized meanings. Also, for convenience and simplicity, the terms "apparatus," "equipment," "machine," and "component" may be used interchangeably with respect to machinery and/or other equipment suitable for use in manufacturing containers, boxes and/or trays, and wherever one such term is used, it also generally encompasses the other terms. The terms "cutout," "opening," "gap," and "hole" are also generally used interchangeably herein, as are the terms "container blank" and "container wrap," but are generally given their art-recognized meanings. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Various embodiments of the present invention relate to apparatuses or equipment for forming containers comprising a reinforced bottom panel. Other embodiments of the present invention relate to methods of forming a container having a reinforced bottom panel. Still, further embodiments of the present invention relate to methods of manufacturing an apparatus or equipment for making a container with a reinforced bottom panel.

The invention, in its various aspects, will be explained in greater detail below with regard to exemplary embodiments. It should be understood that the possible permutations and combinations described herein are not meant to limit the invention. Specifically, variations that are not inconsistent may be mixed and matched as desired.

Figure 1:
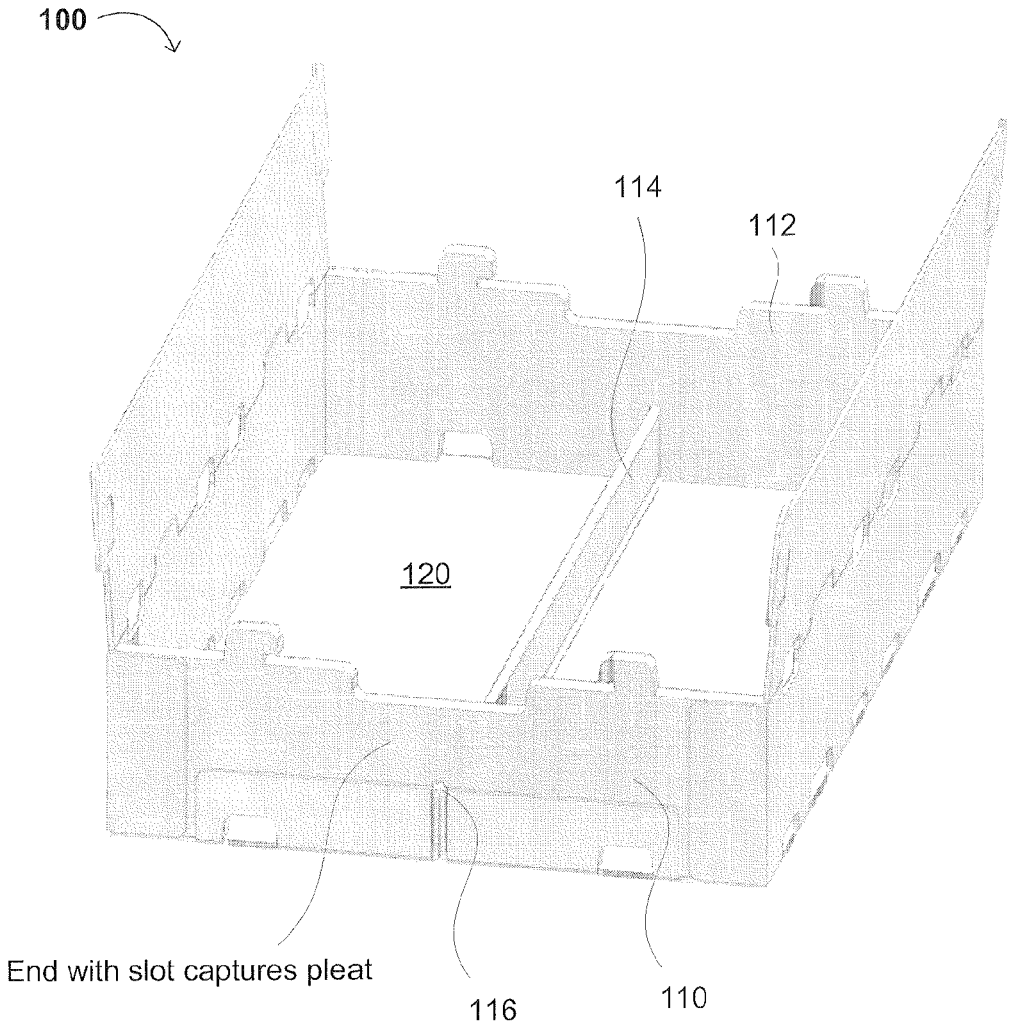
FIG. 1 is a perspective view of an exemplary container (e.g., a bliss-type box) with a pleat in the bottom panel and slits in the end panels.

Exemplary Apparatuses and/or Equipment for Forming Containers with a Reinforced Bottom Panel A first aspect of the present invention relates to apparatuses and/or equipment that form containers with a reinforced bottom panel. For example, FIG. 1 shows an exemplary container 100 having a pleat 114 in and/or across the bottom panel 120. The container 100 also includes end panels 110 and 112, each of which includes a slit 116 that captures the ends of the pleat 114. To reinforce the bottom panel of containers made from corrugated cardboard, such containers generally include one or more pleats that run the length of the container at a 90° angle to the flutes or corrugations, or in the alternative, with the corrugations in the cardboard. Exemplary containers with reinforced bottom panels and/or container blanks with reinforced bottom panels are described in detail in co-pending U.S. patent application Ser. No. 13/275,137, filed on Oct. 17, 2011, which is incorporated by reference herein in its entirety.

Figure 2:
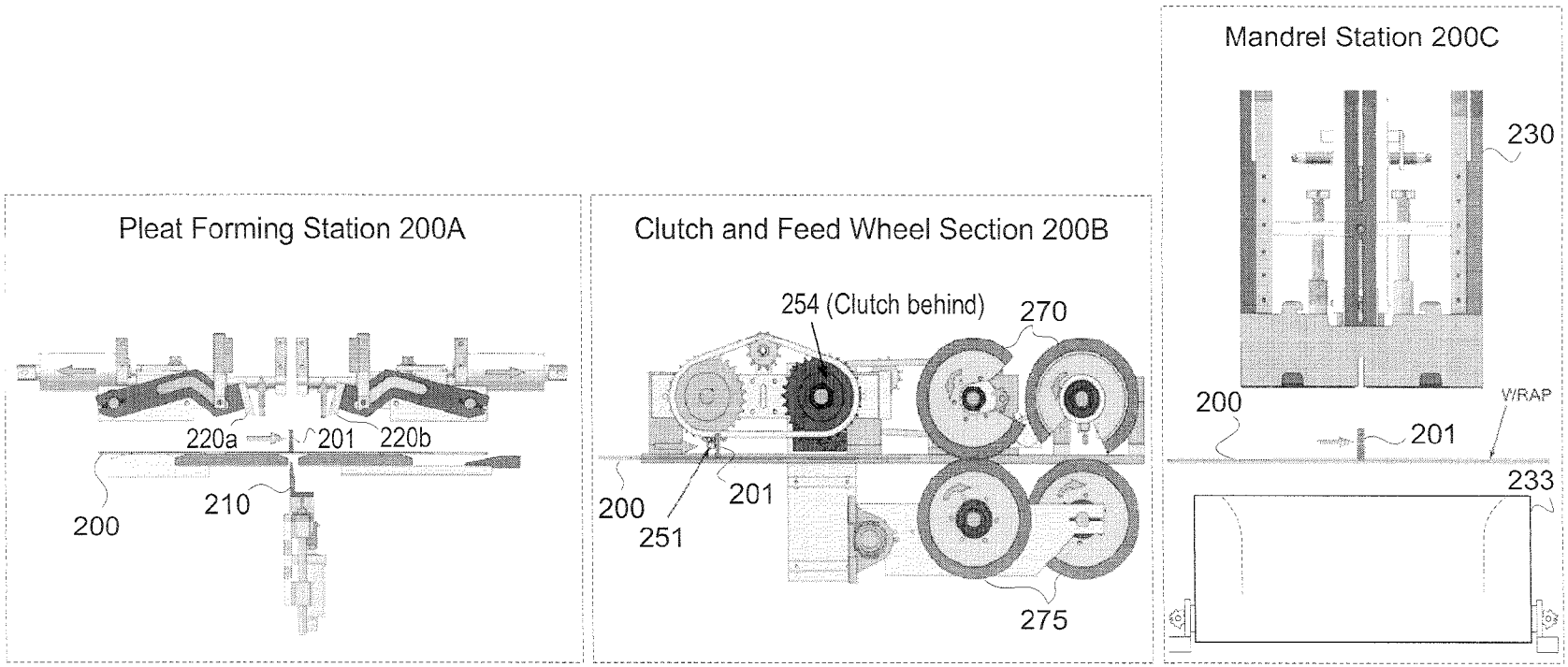
FIG. 2 is a diagram of an exemplary apparatus for forming containers with a reinforced bottom panel in accordance with embodiments of the present invention, including an exemplary pleat forming station, an exemplary clutch and feed wheel section, and an exemplary mandrel station.

FIG. 2 shows a diagram of an exemplary apparatus for forming containers with a reinforced bottom panel according to embodiments of the present invention. In general, the pleat forming apparatus or equipment comprises a pleat forming station 200A, a clutch and feed wheel section 200B, and a mandrel station 200C. The stations or sections 200A, 200B, and 200C work together to make a box or container with a reinforced bottom panel, as a container wrap or blank travels or otherwise passes through each section or station 200A-C. For example, referring still to the apparatus of FIG. 2, in this exemplary embodiment, a container wrap 200 is transferred manually, or alternatively, automatically by conventional automated transfer equipment (e.g., a conveyor, chute, robotic arm, vacuum transfer mechanism, etc.; not shown), into the pleat forming station 200A. In the pleat forming station 200A, a pleat 201 is formed in the container wrap 200 by operation of a breaker bar 210 and score breakers 220*a-b*. After the pleat 201 is formed, the clutch and feed wheel section 200B, comprising a drive mechanism (e.g., a drive motor [not shown] and a clutch 254), a pusher arm 251 and feed wheels 270, 275, moves the container wrap 200 with pleat 201 into the mandrel station 200C. Once in the mandrel station 200C, the container wrap 200 with the pleat 201 is formed into an assembled container by operation of a mandrel 230 and a compression mechanism 233. Each of the stations or sections of the apparatus 200 of FIG. 2 will now be described in detail herein with reference to one or more corresponding figures.

Exemplary Pleat Forming Stations

Figure 3A:
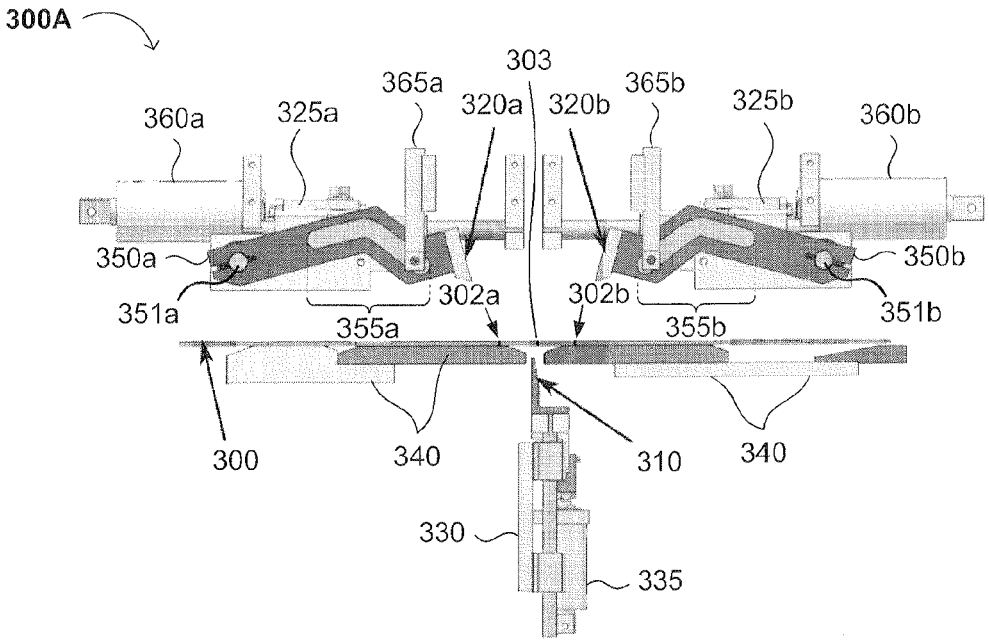
FIGS. 3A-3D are elevation views of an exemplary pleat forming station, showing exemplary operations of the pleat forming mechanism in the various views.

FIGS. 3A-3D show elevation views of an exemplary pleat forming station 300A in various stages of the pleat formation process according to embodiments of the present invention. The pleat forming station 300A described herein is one example of the pleat forming station 200A in FIG. 2, and the structures described in the exemplary pleat forming station 300A may be the same as or different from the structures in pleat forming station 200A. Referring to FIG. 3A, an exemplary pleat forming station 300A includes a platform or other flat surface 340, a breaker bar 310, and a pair of score breakers 320*a-b*.

As shown in FIGS. 3A-3D, typically, the breaker bar 310 and the score breakers 320*a-b* are generally positioned or situated in relation to the platform 340 of the pleat forming station 300A such that the breaker bar 310 is positioned below and at approximately the middle of the platform 340, and the pair of score breakers 320*a-b* are located above the platform 340. In exemplary embodiments, the platform 340 has a hole, gap, or opening therein through which the breaker bar 310 travels when forming a pleat in the container wrap 300. However, in some implementations, the platform may have more than one (e.g., separate) opening or gap therein sufficient to accommodate more than one breaker bar 310 (not shown in the figures). Therefore, the size or width of the opening(s) or gap(s) in the platform may range of from about ½ inch to about 40 inches (e.g., 1.3 cm to 100 cm) or any value or range of values therein capable of accommodating at least one breaker bar 310 (e.g., 1 to 36 inches, 2 to 30 inches, 3 to 27 inches, etc.). In some implementations, the opening or gap may have a sufficiently large size to accommodate more than one breaker bar 310. The platform 340 may be made using any suitable material known in the art (e.g., metal, wood, fiberglass, ceramic, stone, nylon, and/or combination thereof, etc.), and in some instances, the platform may have a non-stick surface or coating (e.g., polytetrafluoroethylene, ethylene tetrafluoroethylene copolymer, fluorinated ethylene propylene copolymer, a non-stick ceramic coating, silicon oxide, etc.) so that the container wrap 300 can move or slide smoothly and easily onto and off of the platform 340.

The breaker bar 310 may be attached or affixed to, or otherwise continuous with, a mechanical arm 330 that is configured to lift and lower the breaker bar 310 to form a fold in a container wrap 300 that is positioned on or secured by the platform 340. The mechanical arm 330 may further comprise one or more hydraulic and/or pneumatic cylinders 335, motors, and/or servo motors, or any other electrical or mechanical device known in the art capable of moving (e.g., lifting and/or lowering) the breaker bar 310. In addition, the mechanical arm 330 may comprise one or more shafts, one or more bearings (e.g., linear bearings), one or more racks, one or more pinion gears, or other mechanical device known in the art capable of guiding the movement of the breaker bar 310 as the breaker bar 310 is lifted and lowered. In exemplary embodiments, the mechanical arm 330 is pneumatically operated and the movement of the mechanical arm is guided by a shaft and two linear bearings. The breaker bar 310 may be attached to or otherwise connected with the mechanical arm 330 using any method known in the art. For example, the breaker bar 310 may be attached to the mechanical arm 330 by one or more screws, bolts, washers, lock washers, nuts, pins, rods, threaded rods, etc., and/or by soldering, welding, brazing, etc. In some instances, the breaker bar 310 may be continuous with the mechanical arm 330. In some embodiments, the mechanical arm 330 may also comprise mechanical stops that may limit the travel of the breaker bar 310 as the breaker bar 310 is lifted and/or lowered. In one embodiment, the breaker bar 310 and mechanical arm 330 may be located above the platform 340 when the score breakers 320*a-b* are below the platform 340.

In exemplary embodiments, the breaker bar 310 is configured to travel through a hole, gap, or opening in the platform 340 to contact a first score line 303 on or in a container wrap 300 and fold the container blank to form (in conjunction with the score breakers 320*a-b* described below) the pleat 301 therein. For example, referring to FIGS. 3A and 3B, in general, the breaker bar 310 is in a first or initial breaker bar position, in which the breaker bar 310 is centrally located relative to the platform 340 and is below an upper surface of the platform 340 (see FIG. 3A). In exemplary embodiments, the breaker bar is positioned directly below or within the opening or hole in the platform 340, and the opening in platform 340 has dimensions enabling the breaker bar 310 to easily move through the platform 340 to contact the container wrap 300 positioned thereon.

Figure 3B:
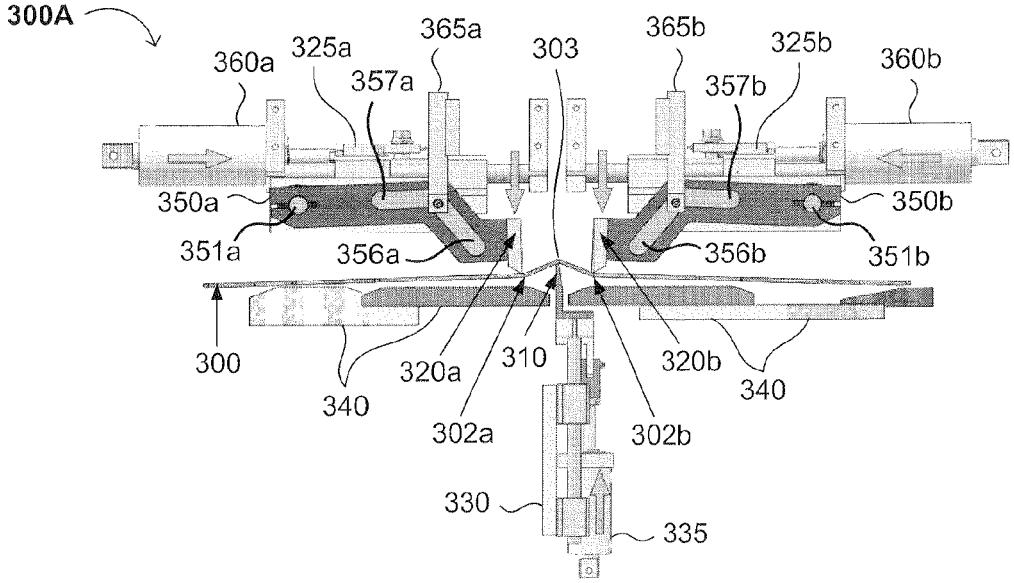
Figure 3C:
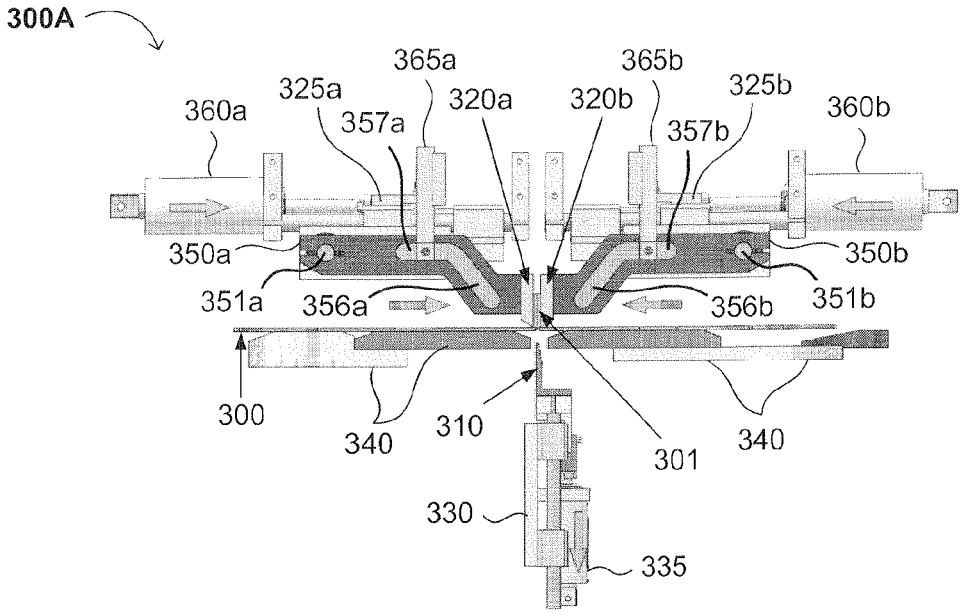
Figure 3D:
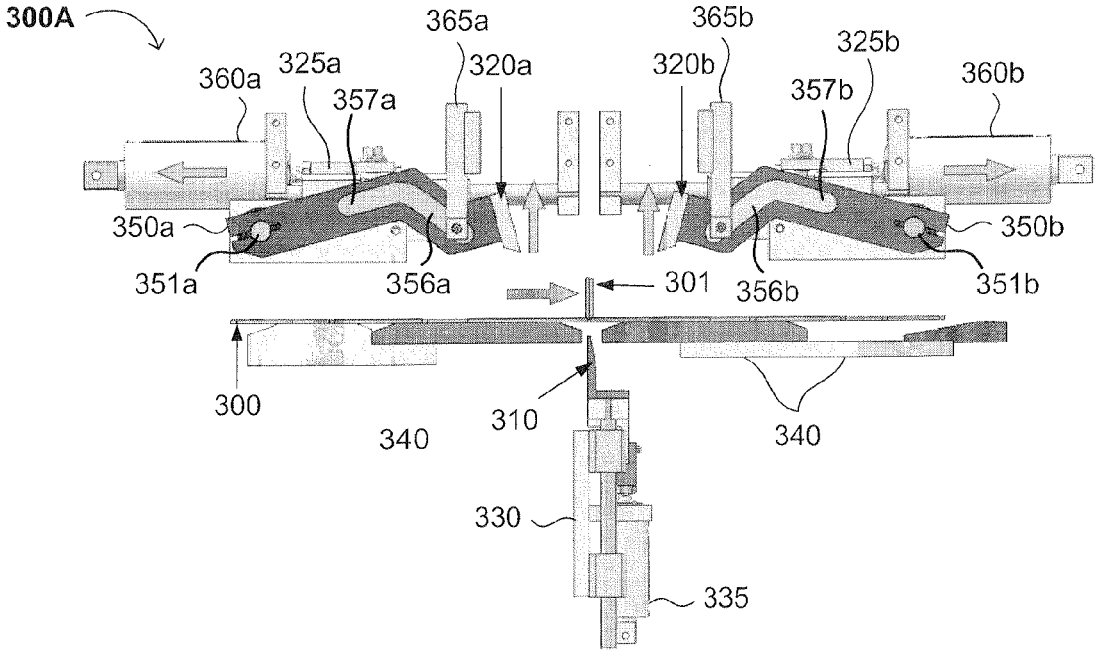

The mechanical arm 330 is configured to lift or move the breaker bar 310 to a second breaker bar position, as shown in FIG. 3B. When the breaker bar 310 is in the second breaker bar position, the breaker bar 310 or a portion thereof has moved through the opening in the platform 340 to contact the container wrap at the first score line 303 previously formed in the container wrap 300 and approximately midway between a pair of second score lines 302*a-b*, parallel to each other and also previously formed in container wrap 300. In exemplary embodiments, the breaker bar 310 is configured to fold the container wrap 300 at the first score line 303, thus creating a first fold and, in conjunction with the score breakers 320*a-b* described below, which contact the container blank at the pair of second score lines 302*a-b*, form a pleat 301 in the container wrap 300. After the breaker bar 310 forms the first fold at the first score line 303, the breaker bar 310 returns to the initial position, as shown in FIGS. 3C and 3D. The first score line 303 may be a single score line or a pair of parallel score lines, wherein the spacing between the parallel score lines corresponds to a thickness of the container blank or an integer multiple thereof. Additionally, a container blank may have more than one first score line 303 and corresponding pairs of second score lines 302*a-b*, wherein each first score line 303 and pair of second score lines 302*a-b* are folded to form a pleat 301. In some variations, two or more pleats may be formed back-to-back so that adjacent pleats have little or no space between them (e.g., 0 inches to about 0.25 inches apart, or any value or range of values therein). In other embodiments, the pleats may be some distance apart in the container wrap (e.g., about 6 inches to about 3 feet apart, or any value or range of values therein).

In some instances in which two or more pleats 301 are folded back-to-to back, the container blank 300 may have a plurality of first fold lines 303 between one pair of second score lines 302*a-b*, as long as the number of first score lines 303 is an odd number (e.g., 3, 5, 7, 9, etc.) such that three first score lines 303 between one pair of second score lines 302*a-b* form two pleats 301, five first score lines 303 between one pair of second score lines 302*a-b* form three pleats 301, seven first score lines 303 between one pair of second score lines 302*a-b* form four pleats 301, etc. In instances having an odd number of first score lines 303 greater than one, more than one breaker bar 310 may be located on one or both sides of the container blank 300, and the breaker bars 310 will be on alternating sides of the container blank 300 as one goes from one second score line (e.g., 302*a*) to the other second score line (e.g., 302*b*). Such arrangement of breaker bars is described below.

Although not shown in the figures, in some variations, the pleat forming station 300A may include a plurality of breaker bars 310 that form one or more pleats in the container wrap 300. For example, a pleat forming station may have 1, 2, 3, 4, or more breaker bars 310, which may operate simultaneously or independently, to form a single pleat (e.g., by side-by-side operation) or multiple pleats (e.g., by face-to-face operation) in a container wrap. In such embodiments, the breaker bars 310 may travel through a single opening or gap, or through separate openings or gaps in the platform 340. In embodiments having more than one breaker bar 310, each breaker bar 310 may have a same or a different vertical height, such that the pleats 301 formed in the container wrap 300 have the same or different heights. In addition, each of the breaker bars 310 may have the same shape or a different shape, and can be made of the same or a different material, as described herein.

In some embodiments comprising more than one breaker bar 310, each breaker bar 310 may be attached to a separate mechanical arm 330 that operates independently of (e.g., operated by a corresponding hydraulic and/or pneumatic cylinder, motor, servo motor, etc.) the other breaker bars 310 to form one or more folds. Alternatively, two or more breaker bars 310 may be attached to the same mechanical arm 330 (e.g., connected in a manifold arrangement) and may operate in unison (e.g., with a single hydraulic and/or pneumatic cylinder, motor, servo motor, etc.) to form one or more folds. In some instances, two or more breaker bars 310 may operate in unison while one or more breaker bars 310 may act independently.

In some implementations, more than one breaker bar 310 may form a single fold. For example two or more breaker bars 310 may be located along the length of the first score line 303 and may contact the first score line 303 simultaneously to form the first fold. In such implementations, the two or more breaker bars 310 may be located adjacent to each other along the length of the first score line 303 with no gap or space between them, and may travel through the same opening or hole in the platform 340 to form a single pleat 301. Alternatively, the two or more breaker bars 310 located adjacent to each other along the length of the first score line 303 may have a gap or space between them and travel though separate openings or holes in the platform 340. In embodiments having an odd number of first score lines greater than one between a pair of second score lines 302*a-b*, the breaker bars 310 may be alternatingly oriented in opposite directions above and below the container blank 300. For example, two breaker bars 310 may be located below the container blank 300 with one breaker bar 310 above the container blank 300 and between the two breaker bars 310 below the container blank 300 (or vice versa) to form two back-to-back pleats 301, three breaker bars 310 may be located below the container blank 300 and two breaker bars 310 above the container blank 300, each of the two breaker bars above the container blank 300 being located between two of the three breaker bars located below the container (or vice versa) to form three back-to-back pleats 301, etc.

The breaker bar(s) 310 may have any suitable shape and/or size for forming the pleat or fold 301 in the container wrap 300. For example, in exemplary embodiments, the breaker bar 310 may have a wedge shape with a relatively flattened top edge that is configured to plow, push, or otherwise move the container wrap 300 in an upward direction to create a bend (which will eventually become 180°) in the container wrap 300, and form the fold or pleat 301. However, in some implementations, the two-dimensional edge-view cross-section of the breaker bar 310 may be a square, a semi-circle, a rectangle, a triangle, and/or a combination thereof, or any other suitable shape known in the art. The breaker bar 310 may have a vertical height or a width of from about 1 inch to about 6 inches (2.5 cm to 15.2 cm) or any value or range of values therein (e.g., 1.5 inches to 5 inches, 2 inches to 4 inches, 3 inches, etc.). The length (i.e., the dimension into and out of the plane of the page in FIGS. 3A-3D) of the breaker bar 310 may range from about 1 foot to about 4 feet (in single bar embodiments) and from 1 inch to 2 feet in (in multi-bar embodiments). Generally, the total length of the breaker bar(s) 310 correspond to the length of the pleat 301 to be formed in the container blank or wrap 300. Consequently, each of the dimensions (e.g., vertical height and/or length) of the breaker bar 310, may correspond to and/or be derived from one or more dimensions of the pleat 301. The breaker bar 310 may comprise one or more metals, one or more plastics, a hard and/or a dense rubber, fiberglass, ceramic, graphite, nylon, wood, a composite, and/or any other material known in the art suitable for plowing, pushing, and/or otherwise creating a bend in the container wrap 300 and forming the pleat 301.

Referring again to FIG. 3A, the pleat forming station 300A includes at least one pair of score breakers 320*a-b*, that generally correspond to and/or work in conjunction with the breaker bar 310 and mechanical arm 330 to form the pleat in the container wrap 300. First score breaker 320*a* is attached or connected to a first cam 350*a* which, in turn, is connected to a first breaker arm 325*a*, and second score breaker 320*b* is attached or connected to an opposing second cam 350*b* which, in turn, is connected to a second breaker arm 325*b*. In general, the score breakers 320*a-b* are configured to move as described herein, and to operate in conjunction with breaker bar 310 to form the pleat 301 in the container wrap 300.

Each cam 350*a*, 350*b* includes a corresponding cam track 355*a-b* (e.g., a slot) formed therein, and a corresponding cam follower 365*a-b*. Each of the cams 350*a-b* may be rotatably attached or connected to pivot shafts 351*a-b* (e.g., by one or more bearings, bushings, sleeves, collars, etc.) such that the cams 350*a-b* rotate on and/or around the pivot shafts 351*a-b*. In such embodiments, the pivot shafts 351*a-b* are fixedly attached to the breaker arms 325*a-b* (e.g., by one or more couplings, pins, locking collars, etc.). In other embodiments, the cams 350*a-b* may be fixedly attached to the pivot shafts 351*a-b* and the pivot shafts 351*a-b* may be rotatably attached to the breakers arms 325*a-b*. The breaker arms 325*a-b* may be attached to or associated with one or more hydraulic cylinders, pneumatic cylinders, motors, and/or servo motors, or any other electrical and/or mechanical device known in the art (e.g., illustrated as reference characters 360*a-b* in FIG. 3A) capable of moving (e.g., lifting and/or lowering, pushing and/or pulling, etc.) the breaker arms 325*a-b*, the cams 350*a-b* and the score breakers 320*a-b*. In exemplary embodiments, the cams 350*a-b* are pneumatically operated. Typically, cam followers 365*a-b* are in a fixed position and may be mounted on a frame that may be fixed on and/or adjacent to the platform 340. In some embodiments, the breaker arms 325*a-b* may be mounted on or attached to (e.g., by linear bearings, rail and linear guides, slides, telescoping slides, racks and pinion gears, etc.) the same or a different frame such that the breaker arms 325*a-b* may move in directions parallel to the platform 340.

In the embodiment shown in FIGS. 3A-3D, each of the cam tracks 355*a-b* has a first section 356*a-b* and a second section 357*a-b* along the length of the cams 350*a-b* (see, e.g., FIG. 3B). The cam followers 365*a-b* (e.g., rollers) are nested in the cam tracks 355*a-b*, but have no fixed attachment to the cams 350*a-b* or the cam tracks 355*a-b*. The cam tracks 355*a-b* are configured to move and/or slide on and/or around the cam followers 365*a-b* to move the score breakers 320*a-b* (e.g., inward and downward) toward the second score lines 302*a-b* on the container wrap 300 and form or help form the pleat 301 shown in FIG. 3D. The linear and/or rotational movement of the cams 350*a-b*, and the corresponding movement of the cam tracks 355*a-b* on and/or around the cam followers control the movement of the associated score breakers 320*a-b*. In some embodiments, the movement of the score breakers 320*a-b* is controlled and/or partially controlled by the horizontal distance between the center of the pivot shafts 351*a-b* and the outside edge of the score breakers 320*a-b* and/or the shape and/or dimensions of the cams tracks 355*a-b*. In exemplary embodiments, the cams 350*a-b* and/or the cam tracks 355*a-b* are configured to move the score breakers 320*a-b* such that the score breakers 320*a-b* contact and move along the same path of travel as the second score lines 302*a-b* (e.g., along one or more arcs and/or angles) as the second score lines 302*a-b* are folded.

For example, as shown in FIG. 3A, the score breakers 320*a-b* and cams 350*a-b* are configured in an initial or first position. The score breakers 320*a-b* are elevated at a first distance from the container wrap 300 on the platform 340 and are positioned away from one another. As shown in FIG. 3A, the cam followers 365*a-b* are located in one end of the first section 356*a-b* of the of the cam tracks 355*a-b* (e.g., the end of the cam tracks nearest the score breakers). As the breaker arms 325*a-b* move inward as shown in FIG. 3B, the cams 350*a-b* move linearly and/or rotate such that the cam tracks 355*a-b* move on and/or around the cam followers 365*a-b*, and the score breakers 320*a-b* move from the initial score breaker position downward toward the container wrap 300 on the platform 340 to a position on and/or above a pair of second score lines 302*a-b* previously formed in the container wrap 300. As shown in FIG. 3B, as the first section 356*a-b* of the cam tracks 355*a-b* move and/or slide downward, the score breakers 320*a-b* move toward the container wrap 300. In some embodiments, simultaneously with the movement of the score breakers 320*a-b* toward the container wrap 300, breaker bar 310 may come up through the opening in platform 340 and/or contact the container wrap.

As shown in FIG. 3C, as the breaker arms 325*a-b* continue to move toward one another, the score breakers 320*a-b* move toward one another and compress the container wrap 300 to form the pleat 301, and breaker bar 310 retracts and/or withdraws through the opening in the platform 340. Specifically, as the second section 357*a-b* of the cam tracks 355*a-b* move and/or slide on and/or around the cam followers 365*a-b* toward the end of the cam tracks 355*a-b* furthest from the score breakers 320*a-b*, the score breakers 320*a-b* move toward one another to form and/or compress the pleat 301.

After the pleat 301 is formed, the breaker arms 325*a-b* move away from one another and the score breakers 320*a-b* move back to their initial positions as shown in FIG. 3D. In some embodiments, the "downstream" score breaker 320*b* moves back to its initial position before the "upstream" score breaker 320*a* moves back to its initial position. In some such embodiments, the upstream score breaker 320*a* may remain in contact with the pleat 301 until pusher arm(s) (e.g., pusher arm 251 in FIG. 2) contacts the upstream side of pleat 301 and/or pushes, propels and/or moves the pleat 301 away from the pleat forming station 300B and towards the feed wheels (see, e.g., feed wheels 270 and 275 in FIG. 2).

The score breakers 320*a-b* may have any suitable shape and/or size for forming the pleat 301 in the container wrap 300. For example, the score breakers 320*a-b* generally have a square or rectangular shape, wherein at least one side has a relatively wide and flat surface configured to compress the sides of the pleat 301, as shown in FIG. 3C. In exemplary embodiments, the side or edge of the score breakers 320*a-b* that contacts the container wrap 300 has an angled surface with a relatively pointed tip that is configured to push, press, or otherwise bend the container wrap 300 to create a 90° bend in the container wrap 300, and assist the breaker bar 310 with forming the fold or pleat 301 (see, e.g., FIGS. 3B-3C). In other embodiments, the score breakers 320*a-b* have no such pointed tip and, instead, the side or edge of the score breakers 320*a-b* that contacts the container wrap 300 is flat. However, the score breakers are not limited as such, and in yet further embodiments, the score breakers 302*a-b* may have any other suitable shape known in the art.

The score breakers 320*a-b* may have a vertical height of from about 1 inch to about 6 inches (2.5 cm to 15.2 cm) or any value or range of values therein (e.g., 1.5 inches to 5 inches, 2 inches to 4 inches, 3 inches, etc.), and in some implementations may have substantially the same or similar vertical height to the height of a corresponding breaker bar 310 or of the pleat 301. The horizontal length (i.e., the dimension into and out of the plane of the page in FIGS. 3A-3D) of the score breakers 320*a-b* may range from about 1 foot to about 4 feet, and generally corresponds to (e.g., is the same or slightly less than) the length of the pleat 301 to be formed in the container blank or wrap 300, and should be approximately the same horizontal length as the total horizontal length of the breaker bar(s) 310. Similar to the breaker bar 310, two or more pairs of score breakers 320*a-b* may be located adjacent to each other along the length of the pairs of second score lines 302*a-b*, and may contact the second score line 302*a-b* simultaneously to form the second folds. Such adjacent score breakers 320*a-b* may be positioned with or without a space or gap between them. Also similar to the breaker bar(s) 310, each of the dimensions (e.g., vertical height and/or horizontal length) of the score breakers 320*a-b*, may correspond to and/or be derived from one or more dimensions of the pleat 301.

The score breakers 320*a-b* may comprise one or more metals, one or more plastics, a hard and/or a dense rubber, fiberglass, ceramic, graphite, nylon, wood, a composite, and/or any other material known in the art suitable for pushing, pressing, and/or otherwise bending the container wrap 300 and creating a bend in the container wrap 300 and forming the pleat 301. Although not shown in the figures, a pleat forming station 300A may include more than one pair of score breakers 320*a-b*. In general, the number of pairs of score breakers may correspond to or be an integer ratio of the number of breaker bars 310 included in the pleat forming station 300A. For example, a pleat forming station 300A may have a pair of score breakers 320*a* corresponding to each breaker bar 310 in the station. Consequently, a pleat forming station 300A may have 1, 2, 3, 4, or more pairs of score breakers 320*a-b*, which may operate simultaneously or independently, to form multiple pleats in a container wrap. In embodiments having more than one pair of score breakers 320*a-b*, each pair of score breakers 320*a-b* may have the same or a different vertical height, such that the pleats 301 formed in the container wrap 300 have the same or different heights, respectively. In addition, each of the pairs of score breakers 320*a-b* may have the same shape or a different shape, and can be made of the same or a different material, as described herein.

In some embodiments, the score breakers 320*a-b* and the breaker bar 310 are configured to move roughly simultaneously. In other embodiments the score breakers 320*a-b* may be configured to move first, before the travel of breaker bar 310, or alternatively, the breaker bar 310 may be configured to travel before the movement of score breakers 320*a-b*.

Although not shown in FIGS. 3A-3D, the pleat forming station 300A may further comprise one or more devices for applying glue or other adhesive to one or more surfaces of the container wrap 300 before the container wrap 300 enters the pleat forming station 300A and/or before the pleat 301 is formed. For example, the pleat forming station 300A may include a device or other adhesive application mechanism configured to apply or dispense adhesive on the surface of the container adjacent to the platform 340 and in areas between the second score lines 302*a-b* so that the adhesive helps hold the sides of the pleat 301 together, and thus provides further support for the pleat 301. The adhesive dispensing and/or applying device may comprise a roll coater, hot melt sprayer, spray gun, nozzle, pump, syringe, brush, sponge or any other suitable adhesive applicator known in the art. In one exemplary embodiment, the adhesive applying device may comprise one or more glue heads configured to spray adhesive onto the desired container blank surfaces.

Exemplary Clutch and Feed Wheel Sections

After the one or more pleats have been formed in the container wrap in the pleat forming station (see, e.g., 200A in FIGS. 2 and 300A in FIGS. 3A-3D), the clutch and feed wheel section of the apparatus (see, e.g., 200B in FIG. 2) moves the container wrap from the pleat forming station to the mandrel station (see, e.g., 200C in FIG. 2). The clutch and feed wheel section 400B described below with regard to FIGS. 4A-4E is one example of the clutch and feed wheel section 200B of FIG. 2, and the structures described in the exemplary clutch and feed wheel section 400B may be the same as or different from the structures described in the clutch and feed wheel section 200B of FIG. 2, the pleat forming station 200A of FIG. 2 and/or the pleat forming station 300A of FIGS. 3A-3D.

Figure 4A:
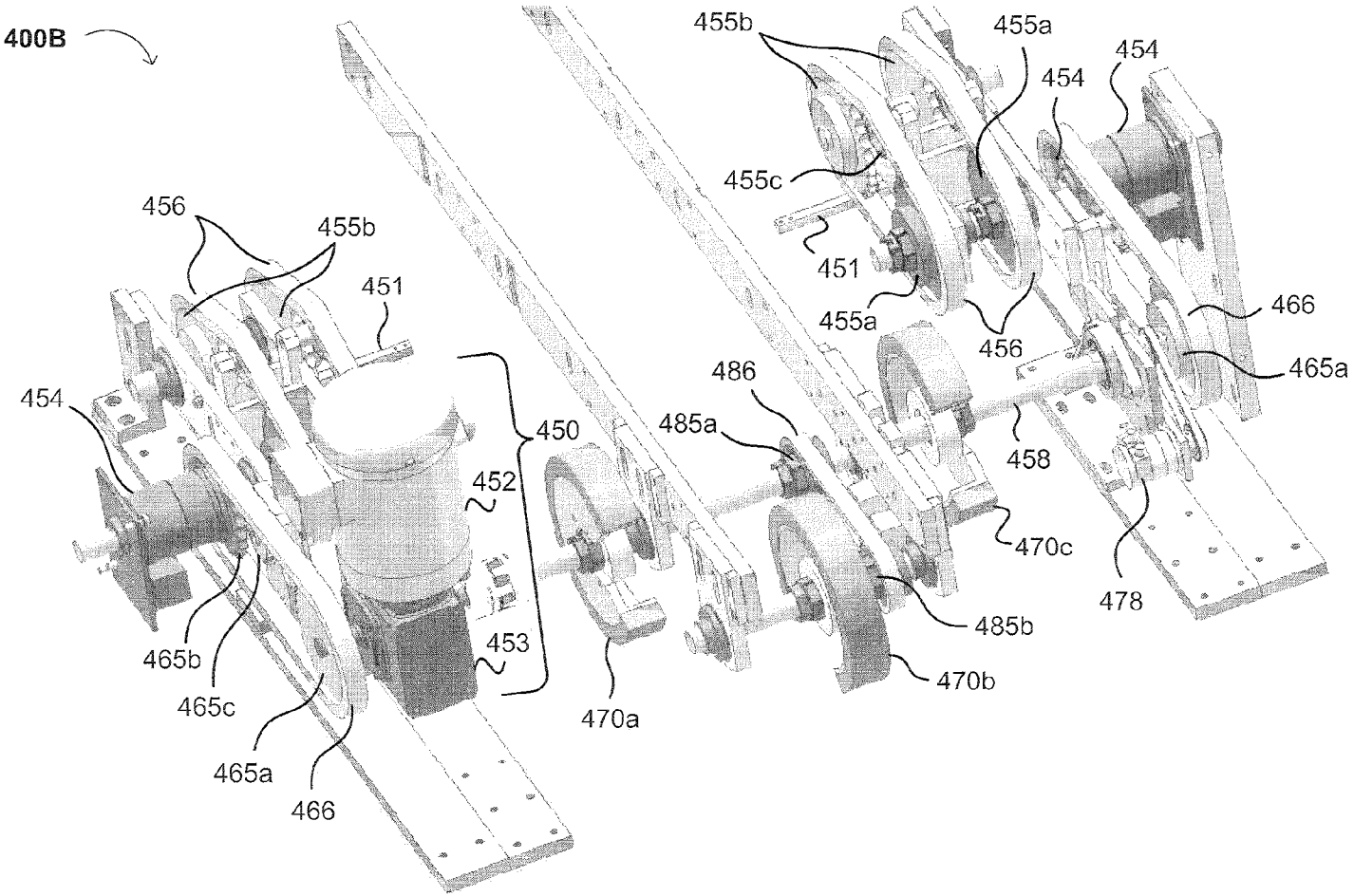
FIG. 4A is a perspective view of a part of an exemplary clutch and feed wheel section of the present invention showing an exemplary drive mechanism including a motor and a gearbox, two clutches, and exemplary feed wheels.

Referring first to FIG. 4A, in general, the clutch and feed wheel section 400B includes a drive mechanism 450 comprising a drive motor 452 and a gearbox 453, at least one clutch 454, at least one gear assembly 455*a-c*/465*a-c* attached thereto, and a plurality of feed wheels 470*a-c*. The clutch and feed wheel section 400B also comprises at least one pusher arm 451 (or a sweeper bar) that is configured to move when the clutch(es) 454 are engaged, and push and/or move a container wrap 400 with a pleat 401 formed therein from the pleat forming station (see e.g., pleat forming station 300A of FIGS. 3A-3D) into the feed wheels 470*a-c*. The feed wheels 470*a-c*, in turn, move the container wrap 400, through the balance of the clutch and feed wheel section 400B, and to a mandrel station (see mandrel station 500C of FIG. 5, 600C of FIGS. 6A-6B, and 700C of FIGS. 7A-7E and the corresponding description herein).

In general, the drive mechanism 450 is connected to and/or operates one or more gear assemblies and a plurality of feed wheels. Specifically, in the exemplary embodiment of FIG. 4A, the drive mechanism 450 comprises a motor 452 and a gearbox 453 which is coupled and/or connected to (i) a rotating shaft 458, to which feed wheels 470*a* and 470*c* are attached, (ii) two clutches 454, and (iii) two pairs of first gear assemblies 455*a-c*, where each pair of first gear assemblies is located on opposing sides of the clutch and feed wheel section 400B and drives one of pusher arms 451. However, the invention is not so limited, and in some embodiments, a single clutch 454 and/or a single gear assembly 455*a-c* may drive one or more pusher arms 451. In the embodiment of FIG. 4A, second gear assemblies 465*a-c* drive the clutches 454, which, when engaged, drive first gear assemblies 455*a-c*. However, in other embodiments, the clutches 454 may be directly coupled or connected to the motor 452 or the gearbox 453. Generally in the embodiment shown in FIG. 4A, after a pleat is formed in the pleat forming station 300A (FIGS. 3A-3D), the clutches 454 engage simultaneously such that the first gear assemblies 455*a-c* drive the pusher arms 451, and the container wrap 400 containing the pleat 401 is moved from the pleat forming station into the feed wheels 470*a-c*. After the container wrap 400 is moved into the feed wheels, the clutches 454 disengage such that the first gear assemblies 455*a-c* cease to operate and/or rotate until such time that a next container wrap 400 with a pleat 401 is ready to be moved from the pleat forming station into the feed wheels 470*a-c*. Typically, one cycle of the clutches 454 (e.g., engaging and disengaging one time) equates to one revolution of the pusher arms 451 (e.g., each of the pusher arms 451 start and stop in the same position). In some embodiments, two drive mechanisms 450, including two motors 452 and/or two gearboxes 453 may operate separately to drive the two clutches, the first gear assemblies 455*a-c* and the feed wheels 470*a-c*. In such embodiments, engaging each of the clutches 454 may be timed such that the container blank 400 moves smoothly and continuously from the pleat forming station through the clutch and feed wheel section 400C and into the mandrel station.

Figure 4B:
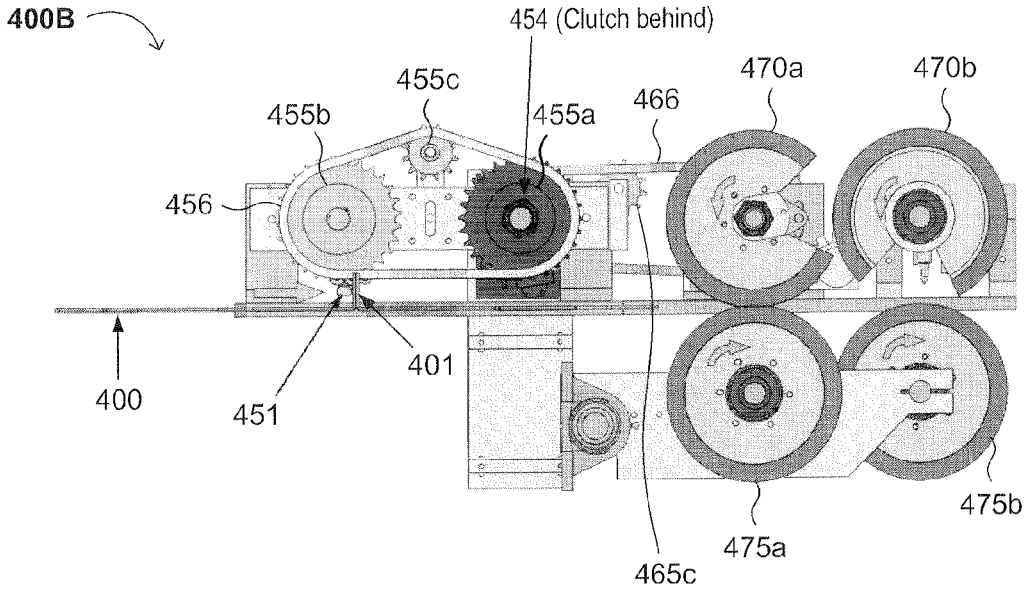
FIGS. 4B-4C are side elevation views of the exemplary clutch and feed wheel section of FIG. 4A showing an exemplary gear assembly and pusher arm (FIG. 4B), and exemplary feed wheels (FIGS. 4B-4C).

Referring to FIG. 4A-4B, when engaged, clutches 454 drive first gears 455*a* in the first gear assemblies 455*a-c*, which drive belts or chains 456 and second gears 455*b*. Optionally, and as shown in FIG. 4A, the gear assemblies 455*a-c* may comprise one or more tension gears 455*c* configured to take up slack in and/or apply tension to the chains 456. In exemplary embodiments, as the drive motor 452, gearbox 453 and clutches 454 rotate the first gears 455*a*, the chains 456 rotate the second gears 455*b* and (optionally) the tension gears 455*c*. In some embodiments, instead of chain drives and gears, the drive mechanism 450 may operate one or more belt drives (e.g., a "V" belt, a multi-grooved belt, a ribbed belt, a timing belt, etc.) and corresponding pulleys.

In the embodiment of FIG. 4A, each pusher arm 451 is attached and/or coupled to a pair of chains 456, and is configured to contact the container wrap 400 on one side (the "upstream" side) of the pleat 401 such that as the chains 456 rotate around the first gear assemblies 455*a-c*, the pusher arm 451 applies pressure to the pleat 401, and the container blank 400 is pushed and/or moved from the pleat forming station 300A through the clutch and feed wheel section 400B. In such embodiment, the pusher arm 451 may be attached and/or coupled to the chains 456 at and/or near an end of the pusher arm 451 such that an opposite end of the pusher arm 451 may contact the pleat without angling downward and/or dragging against the container wrap 400. The pusher arm 451 may comprise one or more bars, flat plates, angles, channels, etc., at least one of which contacts and applies pressure to the upstream vertical side of the pleat 401 to move and/or sweep the container blank 400 into the feed wheels 470*a-b*, 475*a-b*. In some embodiments, the clutch and feed wheel section 400B comprises only one pusher arm 451 driven by the drive mechanism 450 and one or more gear assemblies 455*a-c*. However, in other embodiments there may be two or more pusher arms 451 along the length of the pleat 401, which may be attached and/or mounted to a support frame (not shown), and driven by the same drive mechanism 450 or separate drive mechanisms 450. In some exemplary embodiments, the clutch and feed wheel section 400B includes one or more backup pusher bars, typically downstream of the pusher arm 451 and configured to ensure that the container blank 400 moves into the mandrel station. In such embodiments, the backup pusher bars may be pneumatically operated and/or spring loaded, and/or driven by a drive mechanism and one or more gear assemblies that operates substantially similarly to the drive mechanism 450 and first gear assemblies 455*a-c* described herein. The backup pusher bars may operate independently of the pusher arms 451 and/or the feed wheels 470*a-c*.

The first and second gears 455*a-b* in the first gear assemblies may have a diameter ranging of from about 2 inches to about 8 inches (e.g., 3 to 6 inches, 4 to 5 inches, etc.), or any value or range of values therein. However, in exemplary embodiments, the diameter of the first and second gears 455*a-b* corresponds to and/or is derived from one or more dimensions of the pleat 401 and/or the speed at which the motor and/or the clutch operate. The (optional) tension gear 455*c* is generally smaller than the first and/or second gears 455*a-b*, and the diameter of the tension gear 455*c* may correspond to or be derived from the amount of tension that is desired on the chain drive 456 and/or the diameter of the first and second gears 455*a-b*. The gears 455*a-c* in the first gear assemblies may be made from one or more metals, one or more plastics, fiberglass, nylon, ceramic, composites, or any other material known in the art suitable for rotating and/or otherwise moving the chain 456 and operating the gear assemblies 455*a-c*.

The pusher arm(s) 451 may be square, round, rectangular, triangular, oval-shaped, wedge-shaped, or any other shape known in the art capable of being coupled to one or more chains 456 and pushing or moving the pleat 401 of the container wrap 400. The pusher arm(s) 451 may be made from any of the materials described herein with regard to the gears, score breakers, and/or breaker bar (e.g., metal, nylon, plastic, rubber, fiberglass, ceramic, etc.), and the pusher arm(s) may have any vertical height and/or horizontal length needed to push the pleat 401, but generally, the pusher arm(s) 451 have a height that ranges of from about 10% to about 80% of the height of the pleat (e.g., 25% to 75%, 30% to 60%, 75%, or any other value or range of values therein). The horizontal length (i.e., the dimension into and out of the plane of the page in FIG. 4A) of the pusher arm(s) 451 may range from about 6 inches to about 4 feet. In some embodiments, the horizontal length of the pusher arm(s) 451 may correspond to (e.g., be the same or slightly less than) the length of the pleat 401 formed in container wrap 400. Consequently, each of the dimensions (e.g., vertical height and/or horizontal length) of the pusher arm(s) 451, may correspond to and/or be derived from one or more dimensions of the pleat 401. In embodiments where the length of the pusher arm(s) 451 corresponds to the length of the pleat 401, the end of the pusher arm(s) 451 opposite to the first gear assembly or assemblies 455*a-c* may be attached and/or coupled to one or more gear assemblies that mirror the first gear assembly or assemblies 455*a-c* and operate in conjunction with the first gear assembly or assemblies 455*a-c*. In such embodiments, the gear assembly or assemblies that mirrors the first gear assembly or assemblies 455*a-c* may be driven by the same motor 452, gearbox 453 and/or clutch 454 as the first gear assembly or assemblies 455*a-c*, or may be driven by a separate motor, gearbox and/or clutch. In other embodiments, the end of the pusher arm 451 opposite the first gear assembly or assemblies 455*a-c* may be connected and/or coupled to one or more slots or tracks which support and/or guide the movement of such opposite end of the pusher arm 451. For example, the opposite end of the pusher arm 451 may comprise a roller that travels in a slot formed in a plate or frame, where the slot is configured to parallel and/or mirror the travel of the end of the pusher arm 451 connected to the chain(s) 456.

The drive mechanism 450, comprising the motor 452 and gearbox 453, may also be connected to and/or operate one or more second gear assemblies 465*a-c* that drive clutch(es) 454. Each second gear assembly 465*a-c* may be configured substantially similarly to the first gear assembly 455*a-c* described above. For example, a first gear 465*a* may be connected to a second gear 456*b* via a chain 466, a belt, or any other suitable driving mechanism known in the art. Optionally, the second gear assembly 465 may comprise one or more tension gears 465*c* configured to take up slack in and/or apply tension to the chain 466. As the drive mechanism 450 rotates the first gear 465*a* in the second gear assembly 465*a-c*, the remaining gear(s) 465*b* and/or 465*c* move, as described above with regard to the first gear assembly 455*a-c*. As previously discussed with regard to the first gear assembly 455*a-c*, in some embodiments, instead of a chain drive and gears, the drive mechanism 450 may operate a belt (e.g., a "V" belt, a multi-grooved belt, a ribbed belt, a timing belt, etc.) and corresponding pulleys.

Additionally, the motor 452 and gearbox 453 may be directly and/or indirectly connected and/or coupled to a rotating shaft 458 having at least one feed wheel in the feed wheel assembly (e.g., 470*a*) attached thereto. Consequently, one or more of the feed wheels 470*a-c*, 475*a-b* may be driven by the motor 452 and gearbox 453, and/or one or more of the feed wheels 470*a-c*, 475*a-b* may rotate freely without being driven by the motor 452 and gearbox 453. For example, in one exemplary embodiment, two upstream feed wheels (e.g., 470*a* and 470*c*) on the pleat side of the container wrap 400 may be attached and/or coupled to the rotating shaft 458, and one downstream feed wheel 470*b* may be indirectly connected to rotating shaft 458 via first and second feed wheel gears 485*a* and 485*b* and feed wheel chain 486. Thus, the pleat-side feed wheels (e.g., 470*a-c*) may be driven by the motor 452 and gearbox 453, while the remaining feed wheels (e.g., 475*a-c*) on the non-pleat side of the container wrap 400 may rotate freely.

In exemplary embodiments, some of the feed wheels (e.g., 470*a-c* in FIGS. 4A-4C) are positioned to contact the pleat-side surface of the container wrap 400 and some of the feed wheels (e.g., 475*a-b* in FIGS. 4A-4B) are positioned to contact the opposing (non-pleat) side or surface of the container wrap 400 as it proceeds through the apparatus. Typically, the feed wheels on the pleat-side surface of the container wrap 400 work together with corresponding feed wheels on the non-pleat side of the container wrap 400 to push, propel and/or move the container wrap 400 through the clutch and feed wheel section 400B.

Figure 4C:
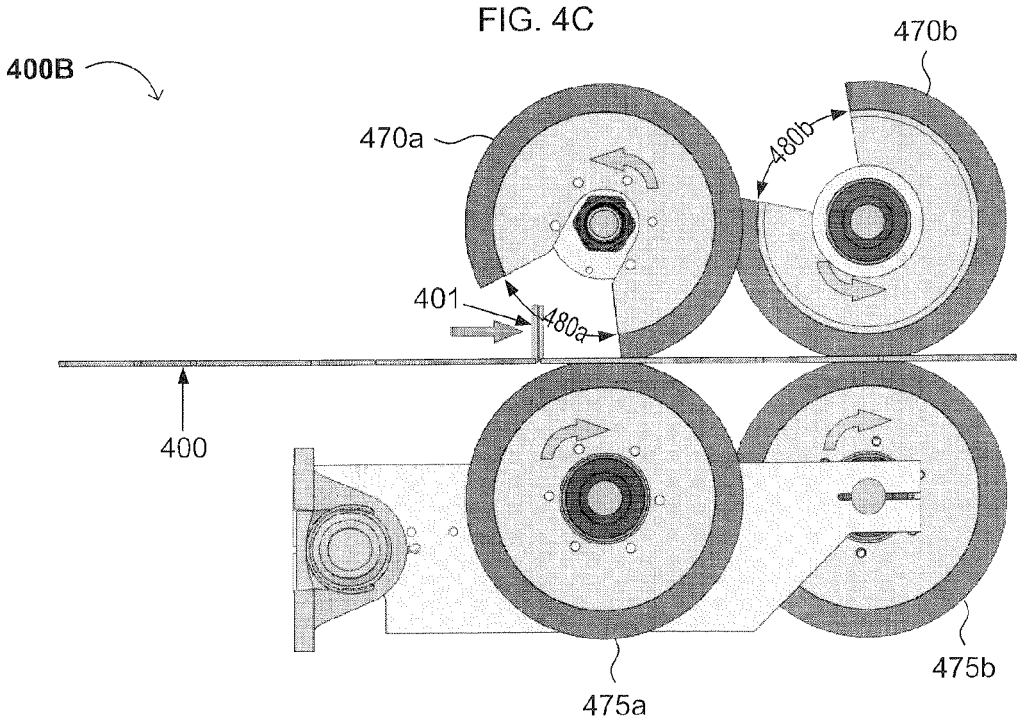
Figure 4D:
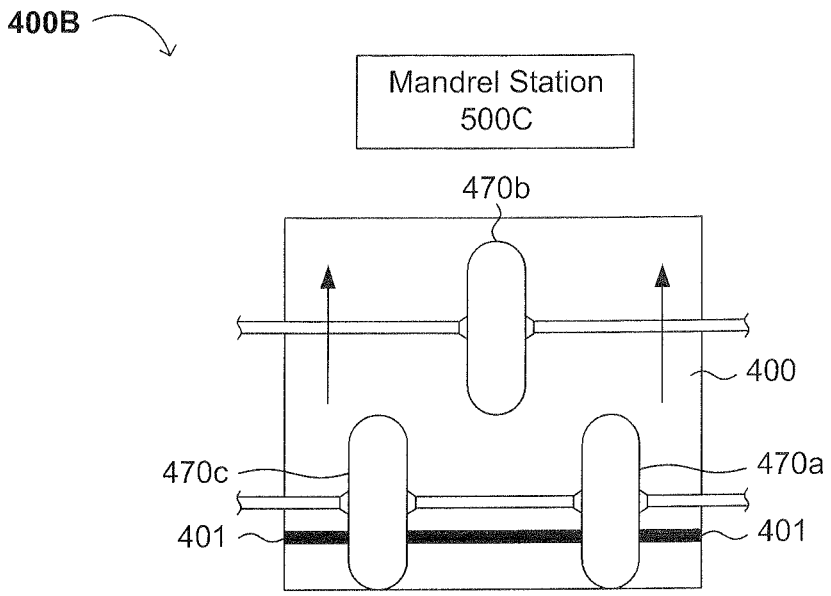
FIG. 4D is a plan view of the exemplary feed wheel assembly in the clutch and feed wheel section of FIGS. 4A-4C.
Figure 4E:
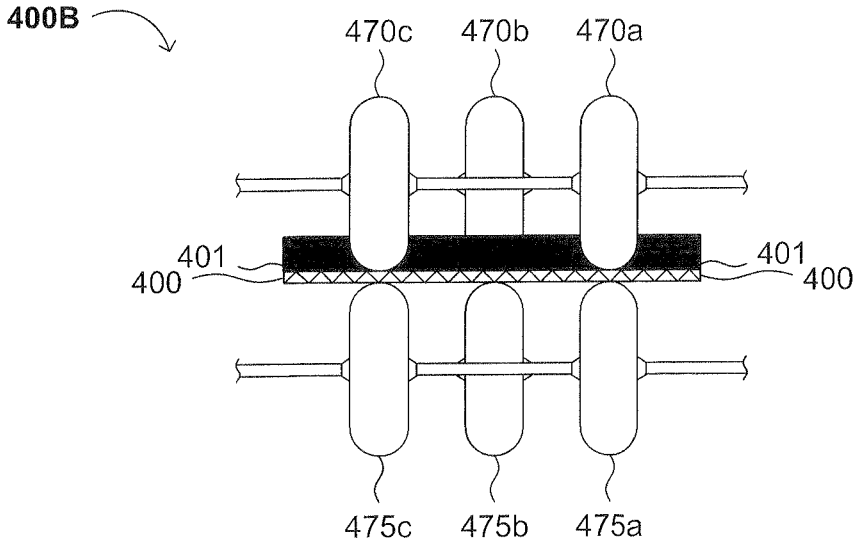
FIG. 4E is a front elevation view of the exemplary feed wheel assembly of FIGS. 4A-4D.

For example, referring to FIG. 4C, each feed wheel 470*a-c* on the pleat-side of the container wrap has a corresponding feed wheel 475*a-c* on the non-pleat side of the container wrap 400 (see also, FIG. 4E). In exemplary embodiments, each feed wheel operates in conjunction with the opposing feed wheel to move container wrap 400 through the clutch and feed wheel section 400B. In general, the feed wheels in each opposing pair (e.g., 470*a*/475*a* and 470*b*/475*b*, etc.) rotate or spin in opposing directions and push the container wrap 400 through the feed wheel assembly. For example, as the arrows in FIGS. 4B-4C indicate, the feed wheels contacting the pleat side of the container (e.g., 470*a-c*; see also FIG. 4A) are configured to rotate or spin in a counter-clockwise direction. In embodiments where the feed wheels (e.g., 475*a-c*) on the non-pleat side of the container blank 400 are not driven or idle, the movement of the pleat-side feed wheels (e.g., 470*a-c*) and/or the container blank 400 cause the feed wheels contacting the non-pleat side of the container to rotate or spin in a clockwise direction (or vice versa). Together, the opposing motion of the feed wheels on each side of the container wrap push, move, or otherwise propel the container wrap 400 through the clutch and feed wheel section 400B in a direction away from the pleat forming station 300A and toward the mandrel station 500C (see, e.g., FIG. 4C).

Figure 5:
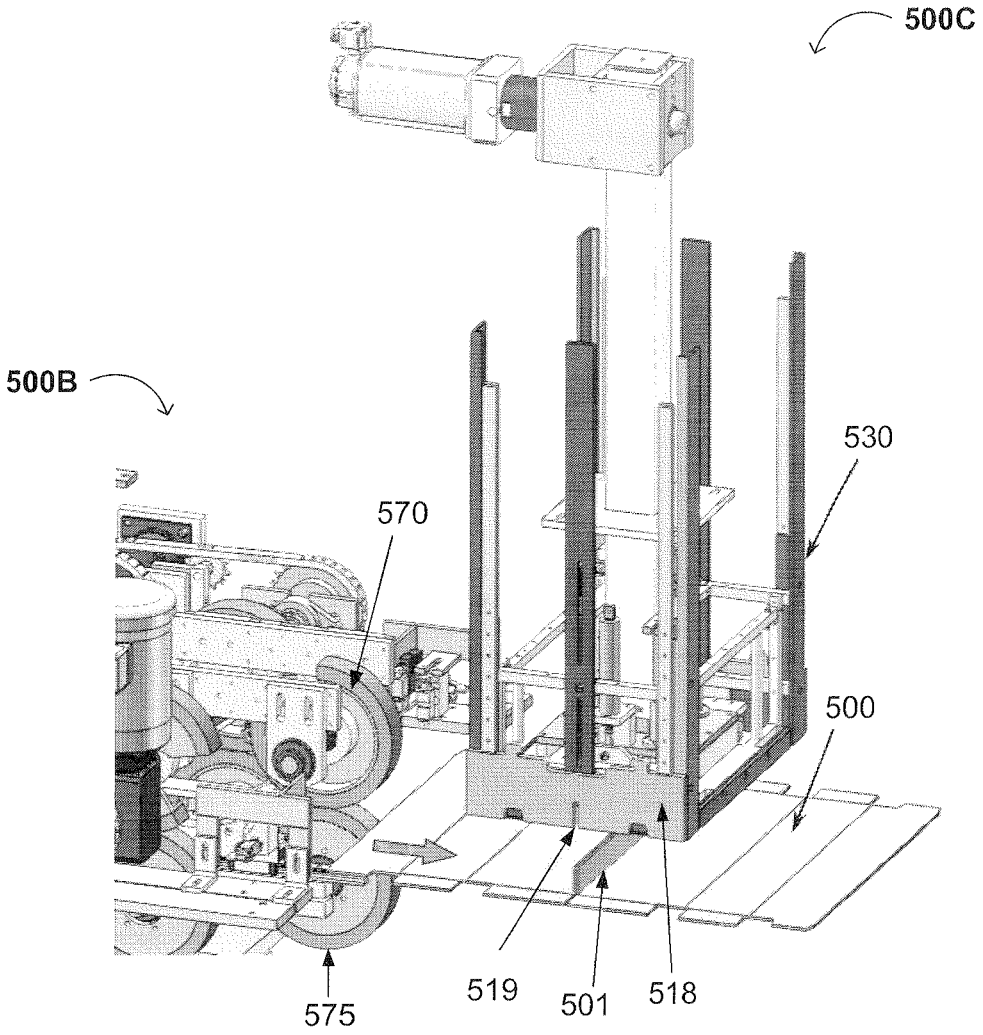
FIG. 5 is a perspective view of a part of an exemplary clutch and feed wheel section and a mandrel station showing an exemplary container wrap as it exits the clutch and feed wheel section and enters the mandrel station in accordance with embodiments of present invention.

Although clutch and feed wheel section 400B in FIGS. 4A-4C shows three pairs of opposing feed wheels (e.g., 470*a*/475*a*, 470*b*/475*b* and 470*c*/475*c*) the clutch and feed wheel section 400B may contain any number of pairs of feed wheels (e.g., one, two, four or more pairs), depending on the width of the container wrap 400 to be moved through the clutch and feed wheel section 400B and/or the distance the container wrap 400 travels to reach the mandrel station 500C (see FIG. 5). The feed wheels (e.g., 470*a-c*, 475*a-c*) are generally placed and positioned in the feed wheel assembly such that they keep the container blank 400 moving in the apparatus.

For example, FIG. 4D shows a top-down view and FIG. 4E shows a side view of a feed wheel assembly having 6 feed wheels (3 pair or sets of opposing wheels). Referring first to FIG. 4D, a first group of feed wheels are positioned on the side of the container blank 400 including the pleat 401. As shown in FIG. 4D, the feed wheels 470*a-c* are arranged with two wheels 470*a* and 470*c* side-by-side at or near opposing edges of the container wrap 400 (e.g., positioned near the right and left edges of the container wrap), and a third wheel 470*b* positioned between the two side-by-side wheels (e.g., near the middle or center of the container blank), and upstream in the apparatus. Consequently, the feed wheel pattern shown in FIG. 4D has a triangular shape when viewed from above. The cutout 480*b* in offset feed wheel 470*b* is angularly offset from the cutout 480*a* in feed wheel 470*a* and the cutout (not shown) in feed wheel 470*c* so that the offset feed wheel 470*b* keeps pressure on the pleat-side surface and keeps the container wrap 400 moving through the feed wheel assembly when cutouts 480*a-b* (see FIG. 4B) of the feed wheels 470*a-b* pass over the pleat 401.

Referring now to FIG. 4E, the assembly also includes three feed wheels 475*a-c* in contact with the opposite side of the container blank (i.e., the non-pleat side of the container blank), which correspond to the feed wheels 470*a-c* in FIG. 4D. For example, the feed wheels 475*a-c* are also arranged with two wheels 475*a* and 475*c* side-by-side at opposing edges of the container wrap 400 (e.g., positioned near the right and left edges of the container wrap 400), and the third wheel 475*b* positioned between the two side-by-side wheels (e.g., near the middle or center of the container blank 400), and upstream in the apparatus. The feed wheels 475*a-c* on the non-pleat side of the container blank 400 contact and apply pressure to the non-pleat side of the container blank 400.

However, the invention is not limited to the arrangement or pattern shown in FIGS. 4C-4D, and the wheels of the assembly may be positioned in any pattern desired that is configured (i) to keep the container wrap 400 moving through the feed wheel assembly and into the mandrel station, and (ii) move the wrap without crushing and/or damaging the pleat(s). To keep the container wrap 400 moving through the feed wheels, at least one feed wheel must contact the container wrap 400 when the wrap 400 is no longer being pushed or moved by the pusher arm(s) 451, until the wrap 400 is moved into and/or under the mandrel. Thus, the center of the axis of rotation of the upstream feed wheel(s) (e.g., 470*a*, 470*c*) may be located at a distance from the farthest downstream travel of the pusher arm(s) 451 such that the container wrap 400 moves smoothly from the pusher arm(s) 451 to the feed wheels. In some embodiments, the pusher arm(s) 451 may be configured to move the container wrap 400 at a speed that is slower than the speed at which the feed wheel(s) are configured to move the container wrap 400, thereby preventing possible damage to the container wrap 400 and/or the pleat 401. Additionally, the upstream feed wheel(s) (e.g., 470*a*, 470*c*) may be located at a distance from the downstream feed wheel(s) (e.g., 470*b*) such that the downstream feed wheel(s) contact and move the wrap 400 when the trailing edge of the wrap 400 exists the upstream feed wheel(s) and/or when the cutouts (e.g., 480*a* and 480*c*) in upstream feed wheel(s) are over the pleat 401. Such distance between the upstream and downstream feed wheel(s) (the center distance) may be at least partially determined by the distance between the pleat(s) 401 and the leading edge of the container wrap 400 and/or the distance between the pleat(s) 401 and the trailing edge of the container wrap 400. Similarly, the downstream feed wheel(s) may be located at a distance from the mandrel (e.g., mandrel 530 in FIG. 5, 630 in FIGS. 6A-6B, and 730 in FIGS. 7A-7E) such that the downstream feed wheel(s) continue to contact and move the container wrap 400 until the container wrap 400 moves into and/or under the mandrel. Such distance between the downstream feed wheel(s) and the mandrel may be at least partially determined by the distance between the pleat(s) and the trailing edge of the container wrap 400. Further, the cutouts (e.g., 480*a-b*) in the feed wheels may have a cutout angle configured such that the container wrap 400 does not "stall" or stop when being moved from the upstream feed wheel(s) to the downstream feed wheel(s).

To move the container wrap without crushing and/or damaging the pleat(s), the feed wheels may have a diameter such that the height of the cutouts (the radial distance from the edge of the feed wheels to the hub of the feed wheels) allows the pleat(s) 401 to pass under the feed wheels without the hub of the feed wheels contacting the top of the pleat(s) 401. Consequently, the diameter of the feed wheels may be at least partially determined by the height of the pleat(s) 401. Similarly, the cutouts may have an angle that allows the pleat(s) 401 to pass under the feed wheels without the edges of the cutouts contacting the pleat 401. Further, the diameter of the feed wheels, the center distance between the upstream feed wheel(s) and the downstream feed wheel(s) and the phase angle between the cutout(s) in the upstream feed wheel(s) and the cutout(s) in the downstream feed wheel(s) may be configured such that the cutouts in the feed wheels are over the pleat(s) 401 as the pleat(s) 401 pass under the feed wheels.

The distance between the feed wheels (either side-to-side or the center distance between the upstream and downstream feed wheels) in the assembly may range from 6 inches to 4 feet (e.g., 1 to 4 feet, 2 to 3 feet, etc.) or any value or range of values therein. In exemplary embodiments, the feed wheels may have a diameter of from about 3 inches to about 1 foot (e.g., 2 to 10 inches, 4 to 8 inches, 5 inches, etc.), or any value or range of values therein. In addition, the feed wheels may have a width or thickness of from about ¼ inch to about 6 inches (e.g., ½ inch, ¾ inch, 1 inch, 2 inches, etc.) or any value or range of values therein. The feed wheels may comprise one or more metals, plastics, hard and/or dense rubbers, fiberglass, ceramic, wood, nylon, composites, or any other material known in the art, and the outer edge is generally covered or coated with a hard rubber, plastic, fiberglass, or other material known in the art that is suitable for grabbing the container wrap and moving it through the machine. In some embodiments, the outer coating or covering has a smooth surface. However, in other variations, the covering or coating includes grooves or treads to increase friction or improve traction as the container wrap 400 moves. The outer coating or covering may have a thickness ranging from about ⅛ inch to 4 inches (e.g., ½ inch, 1 inch, 2 inches, etc.), or any value or range of values therein. In general, the outer coating or covering has a thickness less than the radius of the wheel.

Referring now to FIG. 4C, in exemplary embodiments, each of the feed wheels 470*a-c* on the pleat side of the container wrap has a cutout section 480*a-c* to allow the pleat 401 formed in container wrap 400 to move through and/or past the feed wheels 470*a-c*. As described above, the feed wheels 470*a-c* are configured to rotate such that the pleat in the container wrap 400 moves through the cutouts 480*a-c* in feed wheels 470*a-c* smoothly and/or continuously without damage to the pleat 401. For example, the feed wheel 470*b* downstream of the feed wheels 470*a*, 470*c* is positioned such that cutout 480*b* in feed wheel 470*b* is at a different angle of rotation than cutouts 480*a*, 480*c* of feed wheels 470*a*, 470*c* so that as the container blank 400 with the pleat 401 travels downstream, the cutout 480*b* in the feed wheel 470*b* is over pleat 401 when pleat 401 is at or near feed wheel 470*b* such that the container wrap 400 travels under the feed wheel 470*b* without damage to the pleat 401. The position or phase angle of the cutout 480*b* in feed wheel 470*b* may be determined by the size of the container blank 400 and position(s) of the pleat(s) 401 (e.g., the distance between the leading edge of the container and the pleat(s)), the horizontal distance (the center distance) between feed wheels 470*a*/470*c* and 470*b*, the diameter of the feed wheels 470*a-c*, the size and/or angle of the cutouts 480*a-c* and/or the speed at which the container blank 400 with the pleat 401 travels through the feed wheels 470*a-c*. In some embodiments, a rotary encoder (e.g., encoder 478 of FIG. 4A) tracks the position of at least one of the cutouts 480*a-c* in the feed wheels 470*a-c*, such that the engagement of the clutch(es) 454 and/or the movement of the pusher arm(s) 451 may be timed to the rotation of the feed wheels 470*a-c*, such that the cutouts 480*a-c* are over the pleat(s) 401 as the container wrap 400 travels through the feed wheels 470*a-c*. The pusher arms 451 (FIG. 4A) and/or feed wheels 470*a-c*, 475*a-c* continue to move the container wrap 400 until the wrap 400 exits the clutch and feed wheel section 400B and/or enters the mandrel station 500C (see FIG. 5). In general, each of the cutout sections 480*a-c* has a size of about 10% to about 35% of the circumference of the feed wheels 470*a-c* (e.g., 15%, 20%, 30%, or any value or range of values therein) and each feed wheel 470*a-c* may have a size that is different than one or more of the other feed wheels 470*a-c*. In some embodiments, the container wrap 400 may travel at a substantially constant speed through the feed wheels, and glue and/or other adhesive may be applied to the edges and/or surfaces of the wrap 400 as the wrap 400 travels through the feed wheels prior to the wrap 400 entering the mandrel station.

In some implementations, two or more pleats 401 may be formed in the container blank 400. In such implementations, there may be more than one cutout section 480*a-c* in each feed wheel 470*a-c*, to allow the two or more pleats 401 to pass through the feed wheels 470*a-c*. Alternatively, the angle of the cutout(s) may be increased to allow the two or more pleats 401 to pass through a single cutout section 480 in each feed wheel 470*a-c*, or the feed wheels 470*a-c* may be sized such that the cutouts 480*a-c* pass over each pleat.

In some embodiments, the clutch and feed wheel section 400C may comprise one or more rollers, a conveyor (e.g., a belt conveyor), and/or a robotic arm, etc., in addition to or instead of the feed wheels 470*a-c* and/or 475*a-c*, to move the container wrap 400 from the pleat forming station 300A (FIGS. 3A-3D) to the mandrel station 500C (FIG. 5). In other embodiments, one or more pusher arms 451 may push the container wrap 400 with the pleat 401 directly into the mandrel station without the use of feed wheels.

Exemplary Mandrel Stations

By operation of the clutch and feed wheel section (see, e.g., 200B in FIGS. 2 and 400B in FIGS. 4A-4C), the container wrap moves or is otherwise transferred to the mandrel station 200C of the apparatus (see FIG. 2). The mandrel station 500C (FIG. 5), 600C (FIGS. 6A-6B), and 700C (FIGS. 7A-7E) are examples of the mandrel station 200C of FIG. 2, and the structures described with regard to the mandrel stations 500C, 600C and 700C may be the same as or different from the structures described in the mandrel station 200C and/or the clutch and feed wheel sections 200B of FIGS. 2 and 400B of FIGS. 4A-4D.

FIG. 5 shows an exemplary embodiment of a mandrel station 500C of the present invention in relationship to the exit end of the clutch and feed wheel section 500B. In the embodiment of FIG. 5, the clutch and feed wheel section 500B is located in close proximity to the mandrel station 500C. Although not shown in FIG. 5, in other embodiments, the mandrel station 500C may be located some distance downstream of the clutch and feed wheel section 500B. The mandrel station 500C generally comprises a mandrel 530, including a mandrel alignment mechanism (not shown in FIG. 5; see, e.g., mechanism 731 of FIG. 7B), and a compression mechanism (see, e.g., compression mechanism 733 of FIG. 7E). The components of the mandrel station 500C are configured to work together to bend and/or shape the container blank 500 and form the container or box having at least one pleat 501 that reinforces the bottom of the container. The components of the mandrel station 500C are described in detail herein with regard to FIGS. 5, 6A-6C, 7A-7E, and 8.

Referring to FIG. 5, in exemplary embodiments, feed wheels 570, 575 transfer the container wrap or blank 500 with the pleat 501 from the clutch and feed wheel section 500B to the mandrel station 500C. As shown in FIG. 5, as the container blank 500 moves from the clutch and feed wheel section 500B, the container blank 500 and the pleat 501 are positioned under mandrel 530. In general, the mandrel is configured to mate the pleats with one or more slits in each of a pair of opposing end panels and/or place the pleats into the slits(s), and fold and/or compress sidewalls and/or attachment flaps of the container blank and form the container. In embodiments forming a tray-type container (e.g., an RSC), the opposing end panels may be attached to and/or part of the container blank (see co-pending U.S. patent application Ser. No. 13/275,137, filed on Oct. 17, 2011), and the mandrel may be configured to fold the opposing end panels, thereby mating the pleat 501 with the end panels. In embodiments forming a bliss-type container or box the mandrel 530 may be configured to position a first end panel 518 for the container (e.g., a bliss-type container or box) on one side of mandrel 530 and a second end panel (not shown in FIG. 5) on the opposite side of mandrel 530. Although not shown in FIG. 5, and as discussed in detail below with regard to FIGS. 6A-6B, in such embodiments, the end panels 518 may be moved toward the mandrel 530 by the motion of a pair of head hopper conveyors (see e.g., conveyors 640 in FIG. 6A), which push, propel, convey, or otherwise move a stack of end panels 518 toward the mandrel 530, and hold the end panels 518 against the mandrel 530 in a position to be pushed onto the container blank 500. The mandrel 530 may also be configured to insert the pleat 501 into the end panel(s) 518 by (1) aligning the pleat 501 with a slit 519 in the end panel, and (2) moving the end panel toward the container blank 500 and/or moving the container blank 500 toward the end panel so that the pleat 501 is inserted in and/or secured by the slit 519. In general, in embodiments having end panels 518 separate from the container blank 500, the first and second end panels 518 are positioned on the mandrel 530 prior to the container wrap 500 with the pleat 501 entering the mandrel station 500C.

Figure 6A:
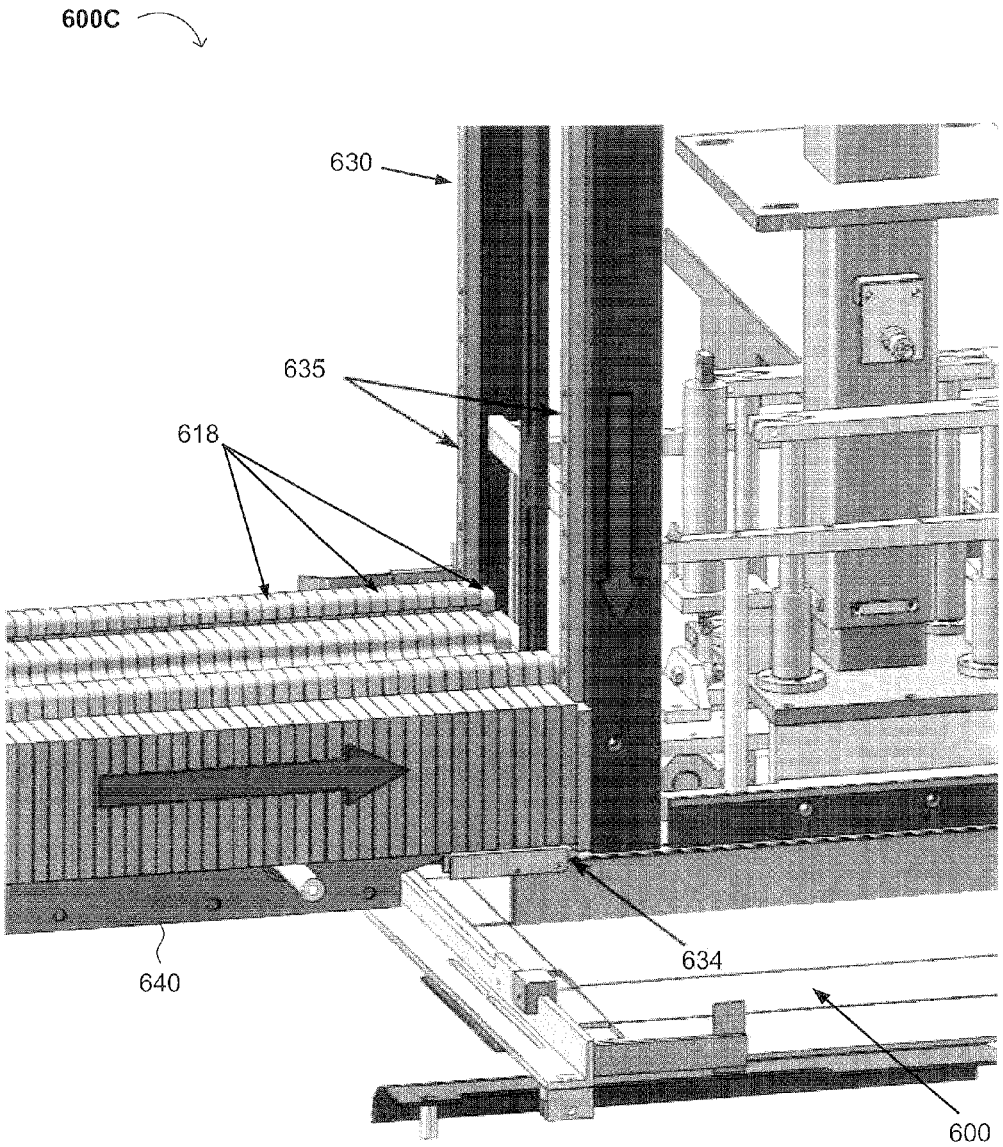
FIG. 6A is a perspective view of an exemplary mandrel station, showing a plurality of end panels positioned on one side of the mandrel station.
Figure 6B:
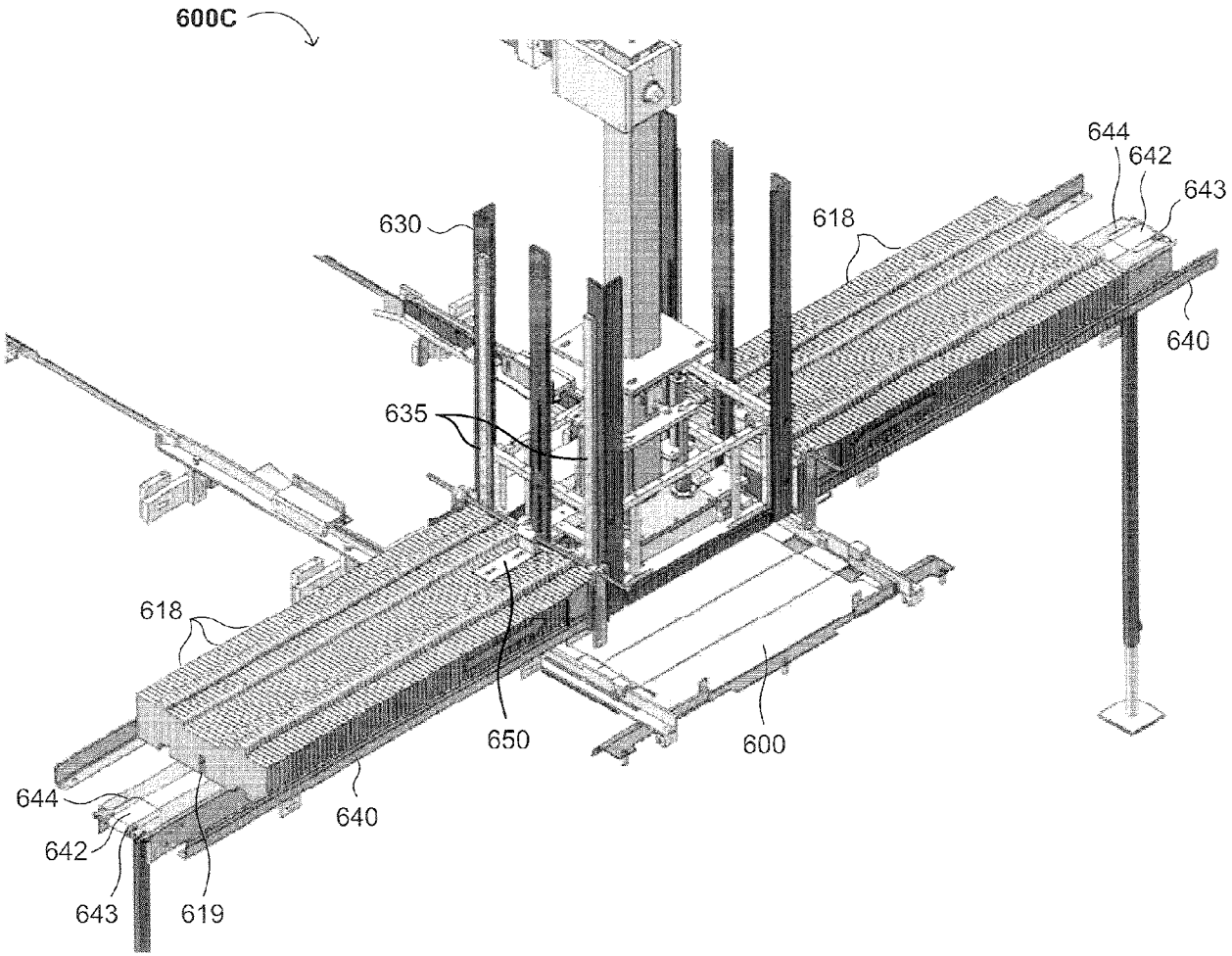
FIG. 6B is a perspective view of an exemplary mandrel station, showing a plurality of end panels positioned on opposing sides of the mandrel station.

Referring now to FIGS. 6A-6B, in some embodiments where the end panels are separate from the container blank 600, the mandrel 630 includes a pair of head hopper conveyors 640. Each of the head hopper conveyors 640 are positioned on opposing sides of the mandrel 630. The head hopper conveyors 640 are configured to hold a plurality of end panels or heads 618 (e.g., for a bliss-type container). The head hopper conveyors 640 push, propel, or otherwise move the end panels 618 toward the mandrel 630, and hold the end panels 618 against the mandrel 630 in a position to be pushed onto the container blank 600. In exemplary embodiments, each of the head hopper conveyors 640 comprises a belt 642 (FIGS. 6B and 6C), which travels along the length of the conveyor 640 and moves the end panels 618 toward the mandrel 630. The belt 642 may wrap around a roller 643 that is driven by a motor (not shown) and propels the belt. In some variations, the belt 642 may be secured by a thin clip or belt guide 644 (e.g., a metal, plastic, nylon and/or fiberglass wire, bar, plate, rod, etc.) that is configured to guide the belt 642 and prevent the belt from twisting, turning, slipping, or becoming otherwise disengaged from the conveyor 640.

Although not shown in the figures, in other embodiments, the end panels 618 may be moved toward and/or held against the mandrel 630 using a spring and lock mechanism, a tension rod, a piston, a cylinder, a motor, or any other mechanism known in the art for moving stacked objects forward. The conveyors 640 may have a length of from about 1 foot to about 6 feet, or any value or range of values therein, and a width of from about 6 inches to about 4 feet, or any value of range of values therein. The length and/or width of the head hopper conveyors 640 may be determined and/or derived from the length, width, and/or thickness of the end panels that will be moved on the conveyor.

Figure 6C:
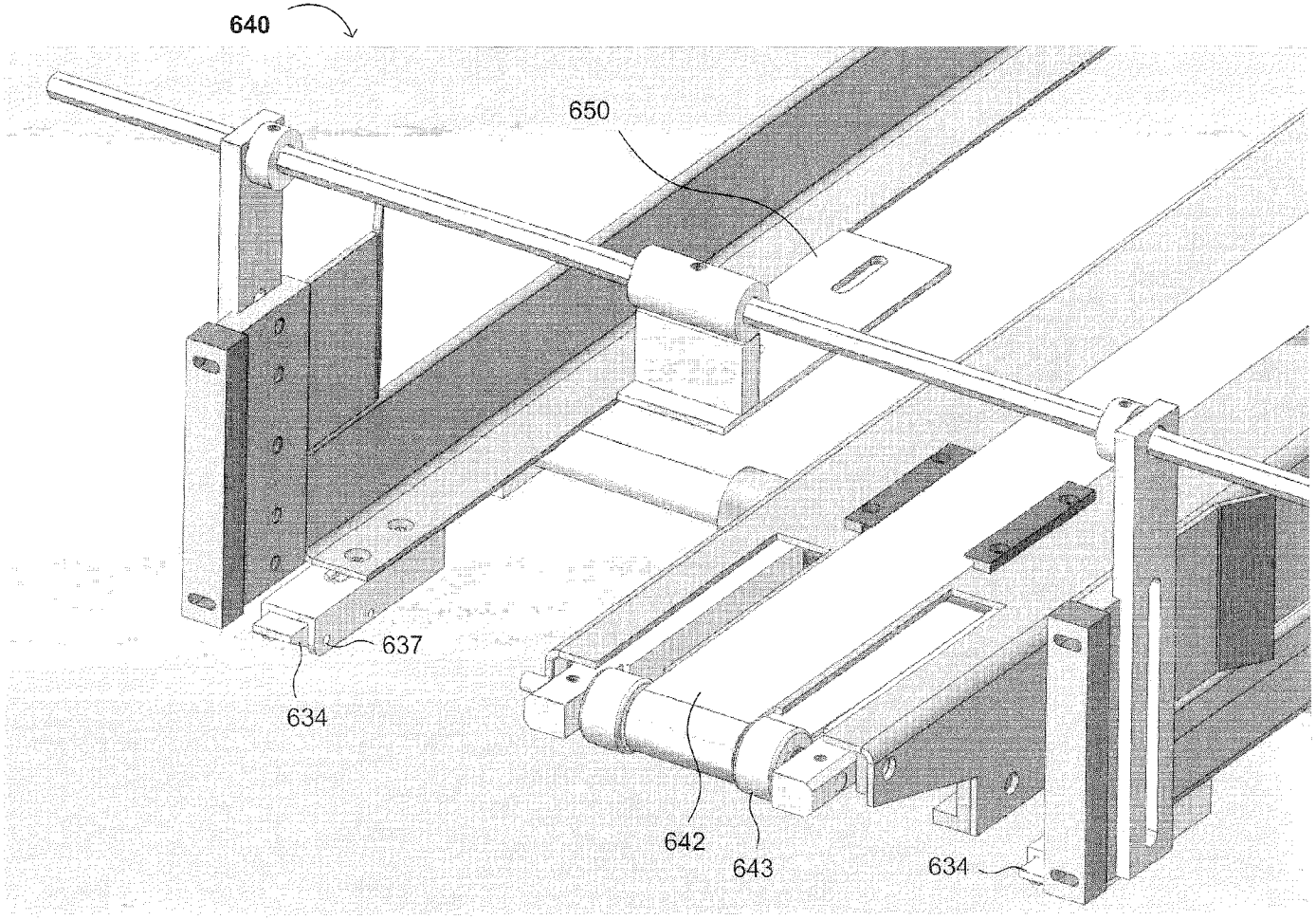
FIG. 6C is a perspective view of a part of an exemplary head hopper conveyor showing the belt, roller, spring fingers and the clip or guide (shown empty of end panels for clarity).

Referring to FIG. 6A, in exemplary embodiments, an end panel 618 is held against the mandrel 630 by one or more spring fingers 634 positioned on opposite sides of the mandrel 630 and/or head hopper conveyor 640 (see also, FIG. 6C). The spring fingers 634 are configured to maintain proper alignment between the end panels 618 and the mandrel 630 so that the end panels 618 may be aligned and/or otherwise positioned correctly on the mandrel 630. The spring fingers 634 are also configured to release only the end panel 618 closest to the mandrel 630 as the stack progresses forward so that only one end panel 618 (e.g., the end panel closest to the mandrel) on each side of the mandrel 630 is positioned on and/or over the pleat (see, e.g., 501 in FIG. 5).

Referring to FIG. 6B, in exemplary embodiments, the head hopper conveyor 640 may include one or more guides, braces, plates, or clips 650 configured to hold a portion of the end panels 618 closest to the mandrel 630 flush, so that the end panels 618 on the stack do not lift or become misaligned as the mandrel 630 retracts from the container blank 600. The guides 650 may have a length of from about 3 inches to about 12 inches (e.g., 4 to 10 inches, 5 to 8 inches, 6 to 7 inches, or any other value or range of values therein), and a width of about ½ inch to about 6 inches (e.g., 1 to 5 inches, 2 to 4 inches, about 3 inches, or any other value or range of values therein), and the length and/or width may be determined by the number of end panels 618 in or on the head hopper conveyor 640. In exemplary embodiments, the guides 650 have a rectangular shape, as shown in FIG. 6B, and may include a perpendicular portion configured to attach the guide 650 to a suspension rod that is attached at both ends to the head hopper conveyor 640 or, alternatively to the mandrel 630. The guides 650 may be made from metal, plastic, rubber, fiberglass, ceramic, nylon, or any other material known in the art.

A plurality of picks 635 are attached to the mandrel 630. The picks 635 are configured to push the end panel 618 closest to the mandrel 630 through and/or past the spring fingers 634 and onto the container blank or wrap 600 (e.g., such that the pleat(s) [e.g., pleat 501 in FIG. 5] go into the slits [e.g., slit 519 in FIG. 5]) as the mandrel 630 moves toward the container blank 600. As shown in FIGS. 6A-6B, the picks 635 generally have a rectangular shape, and the picks may have one or more holes, prongs, plugs and/or extensions to provide a variety of attachment points to connect the picks 635 to the mandrel 630 at one or more desired locations and/or angles. Alternatively, the picks 635 may be inserted into holes or slots in the mandrel 630. In exemplary embodiments, and as shown in FIG. 6A, at least a portion of the bottom edge of the picks 635 (e.g., the edge closest to or in contact with the end panels 618) is slightly angled or is wedge shaped. In such embodiments, the bottom edge of the picks 635 is angled away from the end panels 618, which enables the picks to (1) receive a single end panel 618 as it is released from the spring fingers 634, and (2) push the edge of only one end panel 618 toward the pleat (not shown in FIG. 6A). The picks 634 may have a length of from about 12 inches to 36 inches or any value or range of values therein (e.g., 15 to 30 inches, 20 to 25 inches, etc.). Typically, the picks 635 or a portion thereof (e.g., the end that contacts the end panels 618) may have a thickness less than the thickness of the end panel 618, and a width that is generally less than the width of the end panels 618. In exemplary embodiments, the picks 635 are made from metal, nylon, fiberglass, rubber, ceramic, wood, or any other suitable material known in the art. In some implementations, one or more surfaces of the picks 634 may be coated with a non-stick material, as previously described herein.

FIG. 6C shows a portion of a head hopper conveyor 640 with no end panels thereon so that the spring fingers 634, belt 642 and roller 643 may be clearly seen. As shown in FIG. 6C, the spring fingers 634 may be attached and/or connected to a bracket 636 via a shaft or pin 637. In exemplary embodiments, the end panel (e.g., end panel 618 of FIG. 6A) closest to the mandrel sits on a top surface of spring fingers 634. As the picks 635 push the end panel closest to the mandrel toward the pleat, the spring fingers 634 rotate on and/or around shaft or pin 637 such that the spring fingers 634 move down and/or away from the end panel, thereby releasing the end panel closest to the mandrel so that the pleat (e.g., pleat 501 in FIG. 5) may be mated with the slit (e.g., slit 519 in FIG. 5) in the end panel or the pleat may be placed into the slit. The spring fingers 634 may have a length of about ¼ inch to about 4 inches (e.g., ⅜ to 2 inches, ½ to 1½ inches, about 1 inch, or any other value or range of values therein), and a height of about ¼ inch to about 8 inches (e.g., ⅜ to 6 inches, 1 to 7 inches, about 2 inches, or any other value or range of values therein). The spring fingers 634 may have any suitable shape known in the art. However, in exemplary embodiments, the spring fingers 634 have a square or rectangular shape when viewed in plan, and may have a vertical surface that is angled or partially angled away from the mandrel. In addition, the spring fingers 634 may comprise one or more metals, one or more plastics, rubber, fiberglass, ceramic, nylon, or any other material known in the art capable of maintaining alignment and releasing the end panels 618. The bracket 636 may comprise one or more channels (i.e., an upside down "U" shapes), angles, plates, bars, etc., and may comprise one or more metals, one or more plastics, rubber, fiberglass, ceramic, nylon, or any other suitable material known in the art.

FIGS. 7A-7E show elevation views of an exemplary mandrel station, wherein exemplary components of the mandrel station 700C and their corresponding operations are demonstrated in the various views. The structures of the exemplary mandrel station 700C may be the same as or different from the structures of the mandrel station 200C of FIG. 2, 500C of FIG. 5, and/or 600C of FIGS. 6A-6B. The mandrel station 700C in FIGS. 7A-7E is shown with a container wrap 700 having a single pleat 701, and end panel 718 is shown with a single slit 719. However, the container wrap 700 may have more than one pleat 701, and end panels 718 may have more than one slit 719. In general, the number of slits 719 corresponds to the number of pleats 701. Alternatively, the width of a single slit 719 in each of the end panels 718 may correspond to (e.g., is the same or slightly greater than) the width of a stacked or "multi-pleat" (i.e., a pleat with a plurality of back-to-back pleats; e.g., 2, 3, 4 or more) so that more than one multi-pleat may be captured by the single slit 719.

Figure 7A:
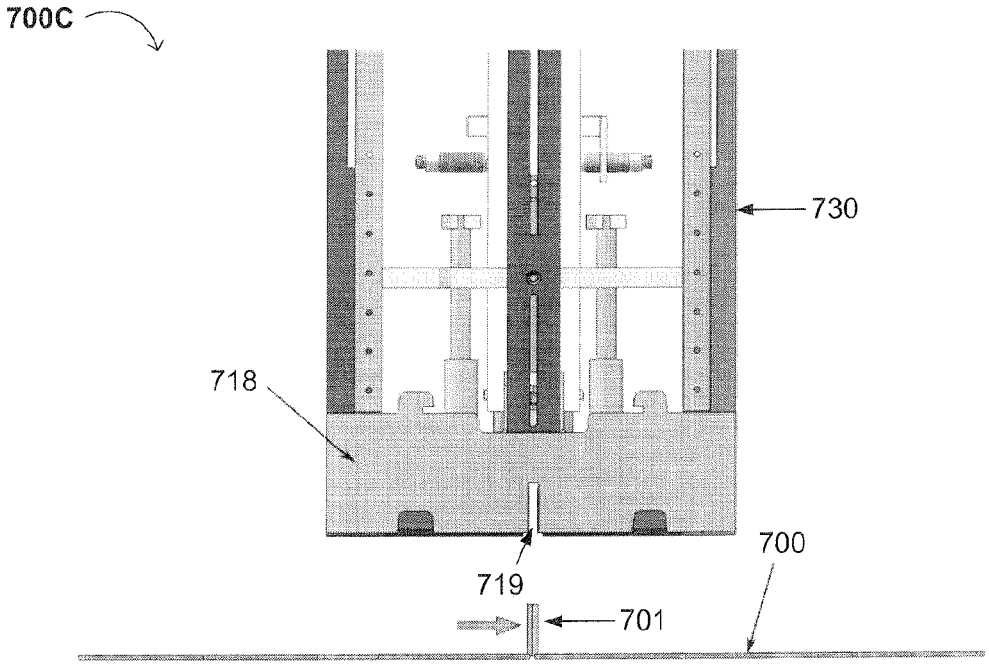
FIGS. 7A-7E are elevation views of an exemplary mandrel station, showing exemplary operations of the mandrel station in the various views.

As shown in FIG. 7A, and in embodiments having end panels 718 separate from the container blank 700, after the end panels 718 are positioned or held in place on the mandrel 730, the mandrel 730 is in an initial mandrel position above the container blank 700 with the pleat 701. In exemplary embodiments, the mandrel 730 comprises a mandrel alignment mechanism 731, which, in some embodiments, comprises a pair of alignment and/or positioning blocks 732 (see, e.g. FIGS. 7B-7C). The mandrel alignment mechanism 731 is configured in an initial position inside of the mandrel 730.

Figure 7B:
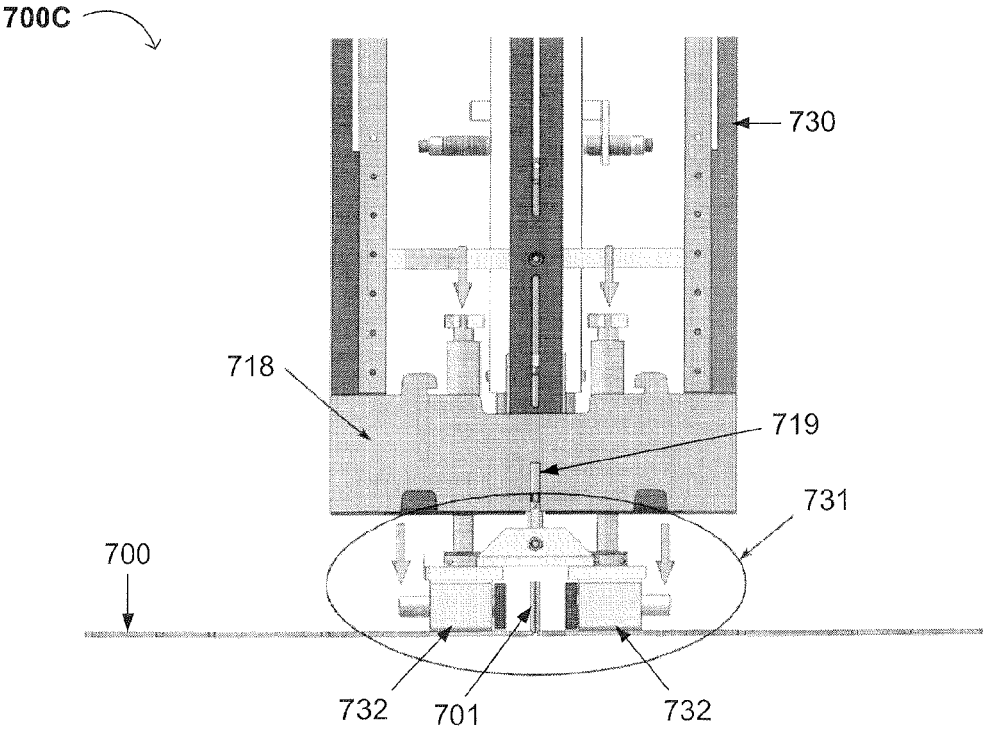

Referring now to FIG. 7B, the mandrel is configured to lower or otherwise move the alignment mechanism 731 to a second position that is above and/or near the pleat 701. In the second position, each alignment block 732 is positioned on an opposite side of the pleat. In exemplary embodiments, the alignment mechanism 731 is operated by one or more hydraulic cylinders, pneumatic cylinders, motors, and/or servo motors. However, the alignment mechanism 731 may be operated by any method or machine known in the art (e.g., mechanical, electro-mechanical, manually [e.g., by hand-crank], computer-driven and/or computer-controlled, etc.).

In some embodiments, the alignment mechanism 731 may have only one pair of alignment blocks 732, which may extend the entire length of the pleat 701. In other embodiments, the alignment mechanism may have two or more pairs of alignment blocks 732, which may be positioned along the length of the pleat 701. The alignment blocks 732 may comprise one or more metals, plastics, rubbers, fiberglass, nylon, ceramic, wood, composites, and/or any other material known in the art suitable for aligning the relatively pliable container blank 700 via its pleat 701. The shape of the alignment blocks 732 may be square, rectangular, triangular, curved, wedge-shaped, or any other suitable shape in the art. However, in exemplary embodiments, the alignment blocks 732 are square or rectangular, and at least one side has a relatively wide and flat surface configured to compress the sides of the pleat. The alignment blocks 732 may have a horizontal length (i.e., the dimension into and out of the plane of the page in FIGS. 7A-7E) of from about 2 inches to about 48 inches, or any value or range of values therein (e.g., 3 to 12 inches, 8 to 36 inches, 15 inches, etc.). In one embodiment, the horizontal length generally corresponds to (e.g., is the same or slightly less than) the length of the pleat 301. In exemplary embodiments, the height of the alignment blocks 732 is from about 50% to 100% of the height of the pleat 701 in the container wrap 700. For example, in one exemplary embodiment, the height of the pleat may be 2 inches. Consequently, in this embodiment, the height of the alignment blocks 732 may range from about 1 to 2 inches.

Figure 7C:
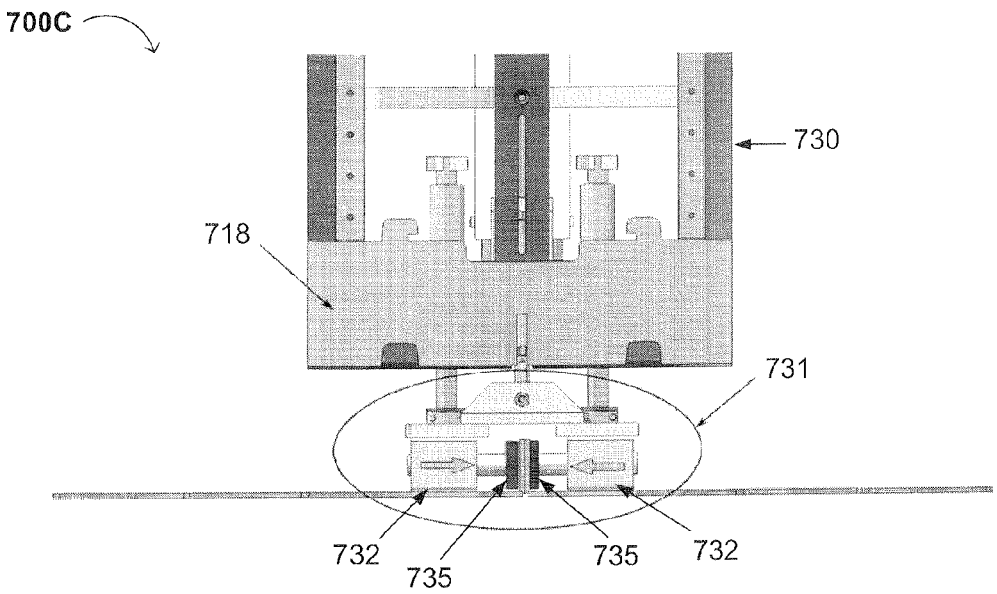

Referring now to FIG. 7C, each one of the pair of alignment blocks 732 attached to the mandrel alignment mechanism 731 is configured to move from the second position (e.g., shown in FIG. 7B) toward the pleat 701 to a third position, as shown in FIG. 7C. In the third position, at least a portion of the alignment blocks 732 contacts, clamps onto, and/or pushes against the pleat 701, thereby aligning (e.g., centering) the container wrap 700 in the mandrel station 700C so that the pleat 701 is aligned with the slit in the end panels 718. For example, as shown in FIG. 7C, in exemplary embodiments, each of the alignment blocks 732 may include a piston mechanism 735 that moves toward the pleat 701, contacts the pleat 701, and aligns the container blank 700 with the end panels 718 on the mandrel 730. The piston mechanism 735 can be operated using any method or device described herein (e.g., hydraulic cylinders, pneumatic cylinders, motors, servo-motors, hand-crank, etc.).

Figure 7D:
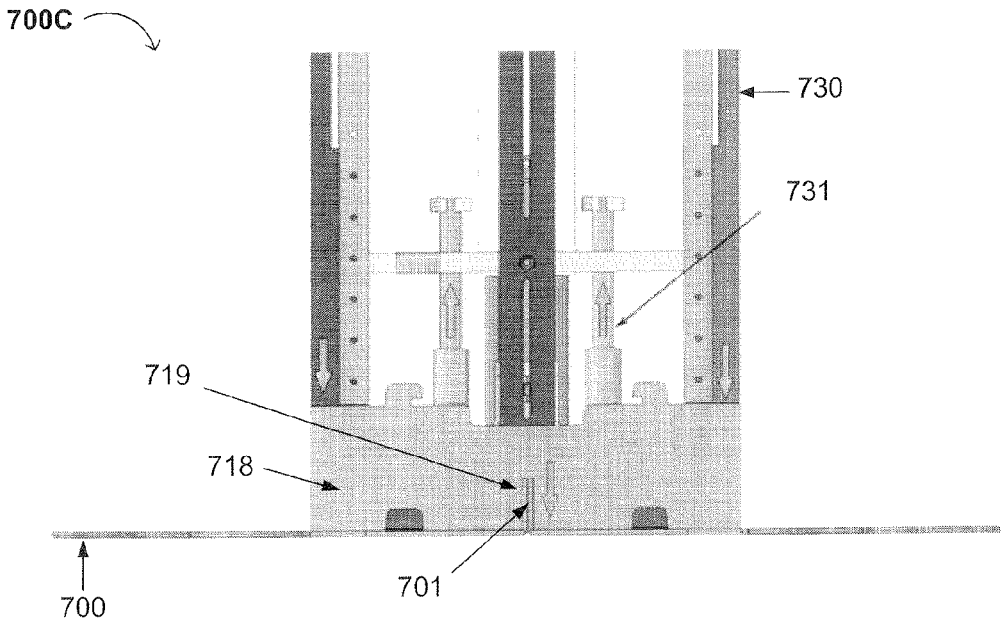

Referring now to FIG. 7D, after the container blank is aligned (e.g., centered) with the end panels 718 via the alignment mechanism 731 in the mandrel station 700C, the mandrel 730 is configured to move toward the container blank 700. For example, the mandrel 730 moves toward the container wrap 700 and pleat 701, thus pushing the end panels 718 into position over the pleat 701 and/or inserting the pleat into slits 719 in the end panels 718. In some embodiments, the alignment mechanism 731 may retract or return to the its initial position inside the mandrel 730 as the mandrel 730 travels downward and/or toward the container blank 700. In such embodiments, (i) the container blank 700 may move upward and/or toward the end panel 718 as the mandrel 730 moves down and/or toward the container blank 700, and/or (ii) the pleat 701 may be mated with and/or or placed into the slits 719 in the end panels 718 before the container wrap 700 is moved into the compression mechanism (see, e.g., 733 in FIG. 7E). In exemplary embodiments, the mandrel 730 is driven by one or more hydraulic cylinders, pneumatic cylinders, motors, and/or servo motors, or any other mechanism known in the art. As the mandrel 730 moves toward the container blank 700, the ends of the pleat 701 are inserted into the slits 719 in the end panels 718, as shown in FIG. 7D, and thus the slit 719 in the end panel(s) 718 effectively "captures" the ends of the pleat 701.

In some embodiments, the alignment blocks 732 are configured to remain in contact with the pleat 701 until the end panels 718 are in contact with the container wrap and/or the pleat 701 is inserted into the slits 719. Thereafter, the alignment blocks 732 return to the initial position. However, in alternative embodiments, the alignment blocks 732 are configured to remain in contact with the pleat 701 as the mandrel 730 travels into the compression mechanism 733, as described below with regard to FIG. 7E. In such embodiments, the alignment mechanism 731 may retract to its initial alignment mechanism position inside the mandrel 730 before the alignment blocks 732 return to their initial block position.

Figure 7E:
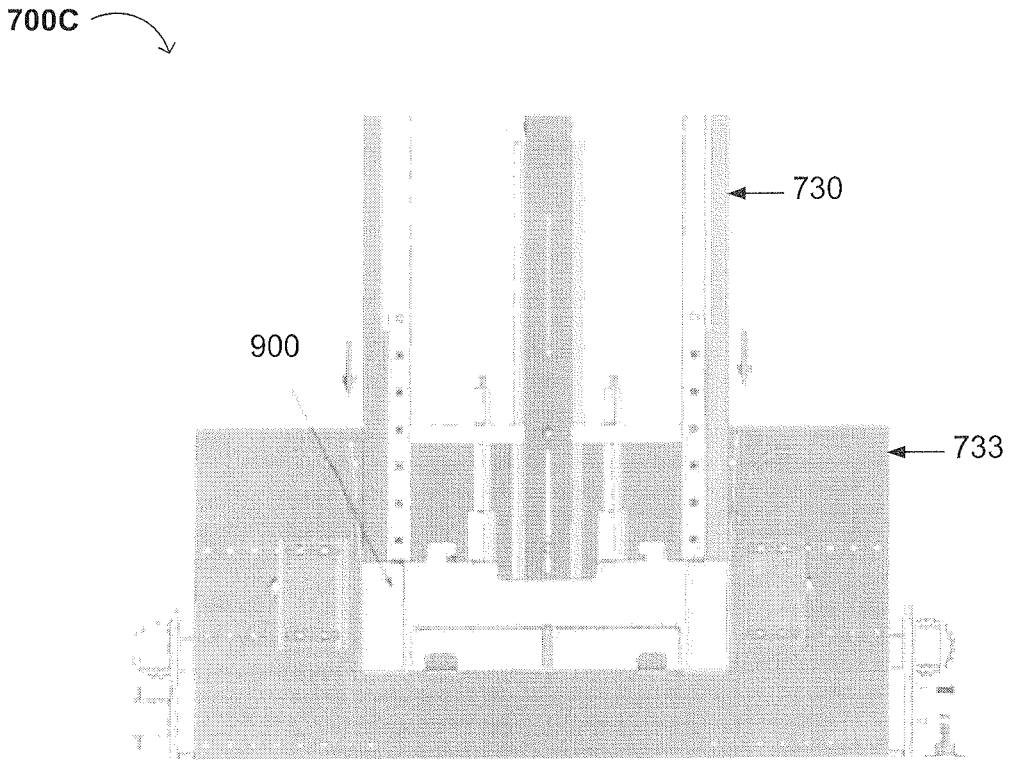
Figure 8:
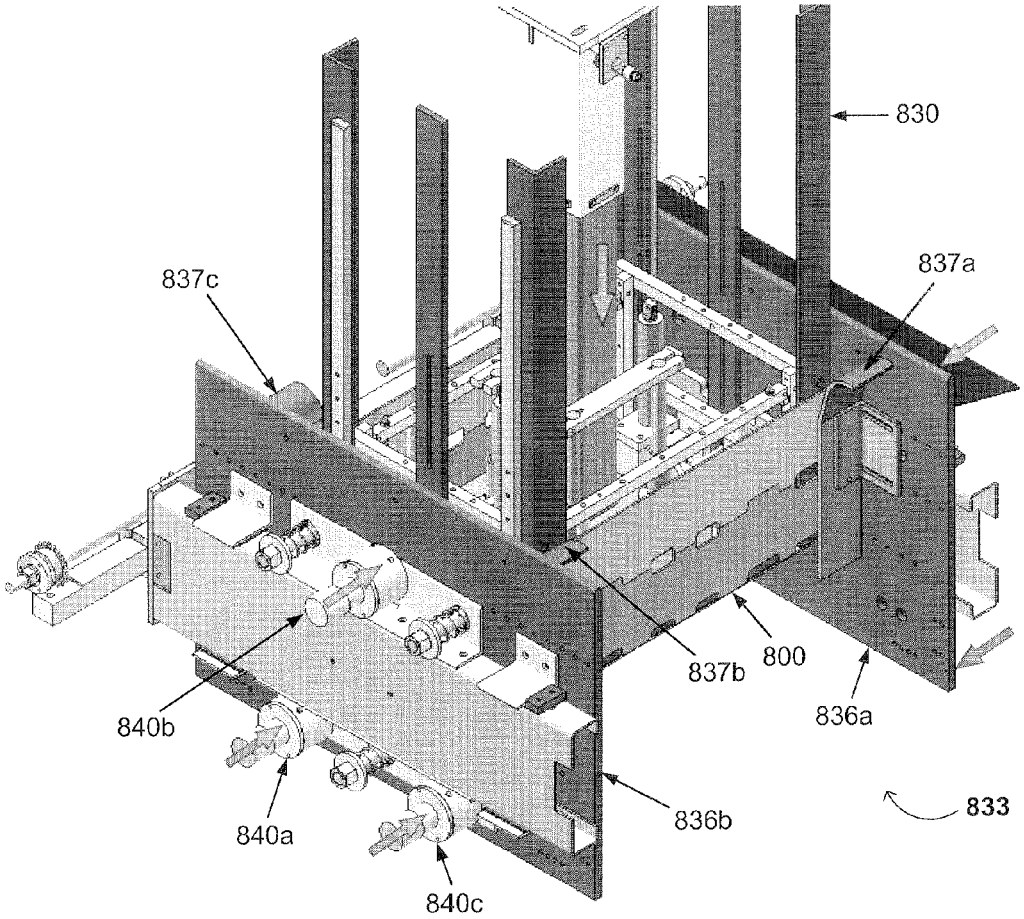
FIG. 8 is a perspective view of an exemplary compression mechanism, showing exemplary compression plates and an exemplary forming shoe.

Referring now to FIG. 7E, the mandrel 730 is configured to continue traveling or moving into a compression mechanism 733. The compression mechanism 733 is configured to force the container wrap 700 to fold around the mandrel 730 and form a fully formed container 900. A perspective view of an exemplary compression mechanism 833 is shown in FIG. 8, and is described in detail herein. The structures shown in FIG. 8 may be the same as or different from the structures shown in FIGS. 5, 6A-6C and 7A-7E.

As shown in FIG. 8, in exemplary embodiments, the compression mechanism 833 comprises a pair of compression plates 836*a-b* and a plurality of forming shoes 837*a-d* (forming shoe 837*d* is obscured from view in FIG. 8 by mandrel 830) adjacent to the compression plates. Each of the forming shoes 837*a-d* is attached to a compression plate 836*a-b* (e.g., via a bracket, hinge, or other attachment mechanism known in the art), and the forming shoes 837*a-d* are generally perpendicular relative to the compression plates 836*a-b*. For example, as shown in FIG. 8, each of the forming shoes 837*a-d* forms a 90° angle with its corresponding compression plate 836*a-b* to which each of the forming shoes 837*a-d* is attached. The forming shoes 837*a-d* are configured to fold the container blank with the pleat (not shown) as the mandrel 830 moves into the compression mechanism 833 and past the forming shoes 837*a-d*. The forming shoes 837*a-d* fold the container blank (see, e.g., 700 in FIGS. 7A-7D) to form sidewalls perpendicular to the end panels (see, e.g., 718 in FIGS. 7A-7E).

The forming shoes 837*a-d* may have any suitable size and/or shape known in the art. For example, the forming shoes may have a length (i.e., a vertical height) of from about 2 inches to about 2 feet (24 inches), or any value or range of values therein (e.g., 6 inches, 10 inches, 12 inches, 14 inches 16 inches, etc.). The forming shoes 837*a-d* may have a width from about a ½ inch to 1 foot (12 inches), or any value of range of values therein (e.g., ½ inch to 4 inches, 1 inch to 8 inches, 10 inches, etc.). In exemplary embodiments, the length and/or width of the forming shoes 837 may correspond to and/or be derived from the height and/or width of the sidewalls of the container blank to be folded. In some variations, and as shown in FIG. 8, the forming shoes 837*a-d* may have a curved shape, sidewall or surface at the container receiving end to create a smooth forming or folding action. In exemplary embodiments, the forming shoes 837*a-b* are relatively thin, and may have a thickness of from about 1/32 inch to about ½ inch or any value or range of values therein (e.g., 3/32 inch, ⅛ inch, 3/16 inch, ¼ inch, ⅜ inch, etc.). The forming shoes 837 may comprise a metal, plastic, rubber, fiberglass, nylon, ceramic, wood, a composite, or any other material known in the art. In some exemplary embodiments, the surface of the forming shoes 837*a-d* may be coated with a non-stick material (e.g., polytetrafluoroethylene, ethylene tetrafluoroethylene copolymer, fluorinated ethylene propylene copolymer, a non-stick ceramic coating, silicon oxide, etc.) to enable the container wrap to slide and fold smoothly in the compression mechanism 833.

The compression plates 836*a-b* are configured to move inward toward the mandrel 830, as indicated by the arrows in FIG. 8, so as to fold end flaps attached to the sidewalls onto the end panels, and to "compress" the fully formed container 800. As shown in FIG. 8, the compression plates 836 may be driven by a plurality of hydraulic cylinders, pneumatic cylinders, motors, servo motors (see, e.g., 840*a-c* in FIG. 8), and/or any other mechanism known in the art capable of moving the compression plates to compress the fully formed container 800.

The compression plates 836*a-b* may have any suitable size and/or shape known in the art, and are relatively large compared to the forming shoes 837*a-d*. For example, the compression plates 836*a-b* may have a length (i.e., a height) and/or a width of from about 1 foot to 6 feet, or any value or range of values therein (e.g., 1.5 to 5 feet, 2 to 4 feet, 3 feet, etc.). Typically, the length of the compression plates 836*a-b* does not equal the width of the compression plates 836*a-b*. As described with regard to the forming shoes, in exemplary embodiments, the length and/or width of the compression plates 836*a-b* may correspond to and/or be derived from the height and or width of the sides of the container blank to be folded. In some variations, and as shown in FIG. 8, the forming shoes 837*a-d* may also have a flat surface at a far end from the initial mandrel position to fold the end flaps and compress the container. In exemplary embodiments, the compression plates 836*a-b* have a thickness greater than that of the forming shoes 837*a-d*. For example, the compression plates 836*a-b* may have a thickness of from about ⅛ inch to about 1 inch or any value or range of values therein (e.g., 3/16 inch, ¼ inch, ⅜ inch, ½ inch, ¾ inch, etc.). The compression plates 836*a-b* may comprise a metal, plastic, rubber, fiberglass, nylon, ceramic, wood, a composite, or any other material known in the art. In some exemplary embodiments, the surface of the compression plates may be coated with a non-stick material (e.g., polytetrafluoroethylene, ethylene tetrafluoroethylene copolymer, fluorinated ethylene propylene copolymer, a non-stick ceramic coating, silicon oxide, etc.) to enable the container wrap to slide and fold smoothly in the compression mechanism.

In some embodiments, one or more glue guns and/or other adhesive application equipment (not shown) may apply glue and/or adhesive to one or more surfaces of the container wrap before the container wrap enters the mandrel station (e.g., in the clutch and feed wheels section as described above), or while the container blank is in the mandrel station before the container blank enters the compression mechanism. For example, the mandrel station 700C (FIG. 7A-7E) may include a device or other adhesive application mechanism (not shown in the figures) configured to apply or dispense adhesive on the surface of the container on one or more surfaces of the end flaps attached to the container sidewalls and/or the end panels. The adhesive helps hold the container together, and thus provides further support for the container. The adhesive dispensing and/or applying device may comprise a roll coater, hot melt sprayer, spray gun, nozzle, pump, syringe, brush, or any other suitable adhesive applicator known in the art. In one exemplary embodiment, the adhesive applying device may comprise one or more glue heads configured to spray adhesive onto the desired container blank surfaces.

Exemplary Methods of Forming a Container Having a Reinforced Bottom Panel

Other embodiments of the present invention relate to methods of forming a container having a reinforced bottom panel, comprising (a) centering a first score line on or in a container blank over a breaker bar, (b) moving a pair of score breakers on or over a second pair of score lines, (c) moving the breaker bar to contact the first score line and bend the container blank to form at least one first fold, (d) moving the breaker bar away from the container blank and moving the score breakers downward and/or toward the first fold(s), until the score breakers form second folds and contact the first fold(s) to form one or more pleats in the container blank, (e) moving the score breakers away from the container blank, (f) moving the container blank into alignment with a mandrel, (g) moving the mandrel toward the container blank, such that (i) the mandrel and/or two opposing end panels on the mandrel contact the container blank, and (ii) the pleat(s) are in one or more slit(s) in each end panel, and (h) folding sidewalls and/or flaps in the container blank approximately perpendicular to and/or around the end panels, thereby forming a container from the container blank and the end panels. The method will be described in detail herein with reference to the figures, and the corresponding description of the apparatus previously described above.

As shown in FIG. 2, a container with a reinforced bottom panel may be manufactured using an apparatus comprising a pleat forming station 200A, a clutch and feed wheel section 200B and a mandrel station 200C. Each of the sections or stations in FIG. 2 work together to make the box or container with a bottom panel reinforced with at least one pleat or rib. In general, a container wrap or blank 200 is transferred into the pleat forming station 200A (e.g., manually or automatically by conventional automated transfer equipment), where a pleat 201 is formed in the container blank 200 by operation of a breaker bar 210 and a pair of score breakers 220*a-b*. After the pleat 201 is formed, the container blank is moved through a clutch and feed wheel section 200B to a mandrel station 200C by operation of a drive mechanism comprising at least one clutch 254, which drives at least one pusher arm 251 and at least one of a plurality of feed wheels 270, 275. After the container blank 200 with the pleat 201 is in the mandrel station 200C, the container is folded into an assembled (completed) container by operation of a mandrel 230 and/or a compression mechanism 233.

Forming the Pleat

FIGS. 3A-3D show elevation views of an exemplary pleat forming station 300A according to embodiments of the present invention. The structures described herein with regard to the exemplary pleat forming station 300A may be the same as or different from the pleat forming station 200A in FIG. 2. Referring now to FIG. 3A, a container wrap 300 enters and/or is placed in the pleat forming station 300A. The container wrap 300 is placed on or is supported by a platform 340 such that the container wrap 300 having at least one first score line 303 and at least one pair of pleat score lines 302*a-b* is aligned at its score line(s) along its width over a breaker bar 310 and under a pair of score breakers 320*a-b*. The breaker bar 310 and the score breakers 320*a-b* are described in detail herein with regard to the exemplary apparatus. The container wrap 300 may be placed and aligned manually, or alternatively, automatically, using conventional automated positioning equipment (e.g., feed wheels, a conveyor with adjustable stops, a chute, a robotic arm, a vacuum transfer mechanism, etc.; not shown). In exemplary embodiments, the breaker bar 310 and score breakers 320*a-b* work together to form the pleat 301 in the container wrap 300.

As shown in FIG. 3A, the breaker bar 310 and the mechanical arm 330 to which it is attached, are in an initial breaker bar position and the score breakers 320*a-b* are in an initial score breaker position. In the initial breaker bar position, the breaker bar 310 is centrally located relative to a hole, gap or opening in the platform 340 and is below an upper surface of the platform 340. In the initial score breaker position, the score breakers 320*a-b* are elevated at a first distance from the container wrap 300 on the platform 340 and are positioned away from one another. A container blank (e.g., 310 in FIG. 3A) with a first score line (e.g., 303 in FIG. 3A) is aligned and/or centered over the breaker bar 310.

Referring now to FIG. 3B, to form the pleat 301, the method comprises moving the breaker bar 310 from the initial breaker bar position through the hole, gap, or opening in the platform 340 to a second breaker bar position, for example by operating one or more pneumatic and/or hydraulic cylinders 335, motors and/or servo motors attached to a mechanical arm (see the section "Exemplary Pleat Forming Stations" above, incorporated herein by reference), and contacting the container wrap 300 at the first score line 303, approximately midway between the pair of second score lines 302*a-b* on the container wrap 300. The movement of the breaker bar 310 effectively folds the container wrap 300 at the first score line 303. In some implementations, the container wrap 300 may have the first score line 303 on the pleat side of the container blank and in some implementation the first score line 303 may be on the side opposite the pleat side of the container blank.

Either before, during (i.e., concurrently with), or after the movement of the breaker bar 310, the method comprises moving the score breakers 320*a-b* inward and/or downward from the initial score breaker position by operating one or more hydraulic and/or pneumatic cylinders 360*a-b*, motors, and/or servo motors, to a position on and/or above the pair of second score lines 302*a-b* in the container wrap 300 such that the score breakers form second folds and contact the first folds to form and/or compress the pleat in the container blank (see FIG. 3C). Typically, the downward movement of the score breakers is concurrent with the upward movement of the breaker bar. In some embodiments, the method also comprises controlling the movement of the score breakers 302*a-b* by moving cams 350*a-b* having cam tracks 355*a-b* formed therein or attached thereto on and/or around corresponding cam followers 365*a-b* (see the section "Exemplary Pleat Forming Stations" above). As shown in FIG. 3C, after the breaker bar contacts the first score line 303, the method may comprise returning the breaker bar 310 to the initial breaker bar position below the surface of platform 340. Typically, the return of the breaker bar to the initial breaker bar position is concurrent with or follows the inward movement of the score breakers described above.

As shown in FIG. 3D, after the pleat 301 is compressed, the method comprises moving (i) the breaker arms 325*a-b* away from one another, and (ii) the score breakers 320*a-b* back to the initial score breaker position. In some embodiments, the method may comprise moving the downstream score breaker 320*b* back to its initial position prior to moving the upstream score breaker 320*a* back to its initial position. In some implementations, the method may then comprise removing the container wrap 300 from the pleat forming station 300A and/or placing another container blank in the pleat forming station 300A.

In some embodiments of the present invention, the method may comprise forming two or more pleats 301 by repositioning the container wrap 300 in the pleat forming station so that the breaker bar 310 is on and/or under a second, third, fourth, etc. first score line and score breakers 320*a-b* are on and/or over second, third, fourth, etc., pairs of second score lines that have been previously formed in container wrap 300. In other embodiments, the method may comprise forming two or more pleats with two or more breaker bars and two or more pairs of corresponding score breakers. In such embodiments, the method may comprise operating each of the two or more breaker bars and/or the two or more pairs of score breakers simultaneously or independently to form multiple pleats in the container wrap.

In additional embodiments, the method may further comprise applying glue or another type of adhesive (e.g., tape, etc.) to an area of the pleat 301 on the underside of the container wrap 300 prior to forming and/or compressing the pleat 301. The addition of such an adhesive may help to hold the pleat together as the container wrap travels from the pleat forming station to the mandrel station. The breaker bar 310 and the score breakers 320*a-b* may have any suitable shape and/or size, and can be made using any suitable material as previously described herein with regard to an exemplary apparatus (see, e.g., the section entitled "Exemplary Pleat Forming Stations" above).

Transporting the Container Blank with the Pleat

FIGS. 4A-4E show views of an exemplary clutch and feed wheel section 400B according to embodiments of the present invention. The structures described herein with regard to the exemplary clutch and feed wheel section 400B may be the same as or different from the clutch and feed wheel section 200B in FIG. 2, the pleat forming station 200A in FIG. 2, and/or the pleat forming station 300A in FIGS. 3A-3D. After the one or more pleats 401 have been formed in the container blank or wrap 400, the container blank 400 moves from the pleat forming station (e.g., 300A of FIGS. 3A-3D) through a clutch and feed wheel section 400B to a mandrel station (e.g., 200C in FIG. 2).

Referring to FIGS. 4A-4E, after forming the pleat 401 in the container wrap 400, the method comprises driving a drive mechanism 450, comprising one or more pusher arms 451 configured to apply pressure to the pleat 401, and pushing, propelling and/or otherwise moving the container wrap 400 out of the pleat forming station 300A and into the feed wheels (e.g., feed wheels 470*a-c* and 475*a-c*). At least one feed wheel (e.g., 470*a*) may also be driven (directly and/or indirectly) by the drive mechanism 450, thereby moving the container wrap 400 through the feed wheels and into mandrel station 500 (FIG. 4C). Specifically, driving the drive mechanism 450 may comprise driving one or more first gear assemblies 455*a-c* operably connected to the drive mechanism 450 via at least one clutch 454, thereby driving the pusher arm(s) 451 and at least one feed wheel (e.g., 470*a*) to move the container wrap 400 into the mandrel station 500 (for a detailed description of the components of the clutch and feed wheel section 400B, see the section entitled "Exemplary Clutch and Feed Wheel Sections" above, incorporated herein by reference). In some embodiments, driving the drive mechanism 450 may also include (i) engaging the clutch(es) 454 after the pleat 401 has been formed in the container blank 400 such that the first gear assembly or assemblies 455*a-c* drive the pusher arm(s) 451 to move the container blank 400 into the feed wheels and/or (ii) disengaging the clutch(es) 454 after the container wrap 400 moves into the feed wheels, such that the motor idles and the first gear assembly or assemblies 455*a-c* cease to operate and/or rotate until such time that a next container wrap 400 is ready to be moved from the pleat forming station 300A into the feed wheels. In some embodiments, one or more second gear assemblies 465 may drive the clutch(es) 454, while in other embodiments, the clutches may be directly coupled or connected to the motor 452 or the gearbox 453.

In some implementations, driving the pusher arm(s) 451 may comprise driving or rotating one or more chains 456 to which the pusher arm(s) are attached and/or coupled until the pusher arm(s) contact the container blank 400 on the upstream side of pleat 401 and apply pressure on the pleat 401 as the chain(s) move, to push, propel and/or move container blank 400 from the pleat forming section 300A through the clutch and feed wheel section 400B. In some variations, the method may further comprise operating one or more backup pusher bars, typically downstream of the pusher arm(s) 451 and/or the feed wheels to move the container blank 400 into the mandrel section. Such back-up pusher bars are generally operated independently of the feed wheels, but in some variations, may be operated with the feed wheels.

Generally, driving the drive mechanism 450 also comprises driving at least one feed wheel in the feed wheel assembly (e.g., 470*a*) such that one or more of the feed wheels 470*a-c*, 475*a-c* may be driven by the drive mechanism 450 and/or one or more of the feed wheels 470*a-c*, 475*a-c* may rotate freely without a being driven by drive mechanism 450. The drive mechanism 450 rotates at least some of the feed wheels (e.g., 470*a*-470*c*), thereby moving the container wrap 400 through the clutch and feed wheel section 400B.

In exemplary embodiments, some of the feed wheels may contact the pleat-side surface of the container blank 400, and some of the feed wheels may contact the non-pleat side of the container blank 400 as the container blank 400 proceeds through the apparatus. Consequently, in such embodiments, the method may also comprise rotating or spinning the wheels contacting the pleat side of the container (e.g., 470*a-b*) in a counter-clockwise direction, thereby (via contact with the moving container blank 400) rotating or spinning the wheels contacting the non-pleat side of the container (e.g., 475*a-b*) in a clockwise direction (or vice versa, depending on the direction in which the container blank 400 travels). Such rotation or spinning of the feed wheels pushes, moves, and/or propels the container wrap 400 through the clutch and feed wheel section 400B in a direction away from the pleat forming station 300A and toward the mandrel station 500C (see FIG. 4C).

As shown in FIGS. 4B-4C, each of the feed wheels on the pleat side of the container wrap 400 includes a cutout section (see, e.g., cutouts 480*a-b* in feed wheels 470*a-b*), and the method further comprises rotating the feed wheels such that the pleat 401 in the container wrap 400 is in and/or under the cutout sections of the feed wheels until the pleat 401 exits the cutout(s) in the feed wheels and/or enters the mandrel station (see FIG. 5). In embodiments having one or more feed wheels downstream of other feed wheels in the feed wheel assembly, the method may also comprise positioning cutout(s) in the downstream feed wheel(s) at a different angle of rotation than the cutout(s) in the upstream feed wheel(s) such that the container blank 400 with the cutout 401 moves through the feed wheel section without damage to the pleat.

In some embodiments, the pusher arm(s) 451 may move independently from the feed wheels because the first gear assembly or assemblies 455*a-c* that drive and/or operate the pusher arm(s) 451 may be connected to a first drive mechanism 450 (e.g., a drive motor, gearbox and/or a clutch) and one or more of the feed wheels may be connected to a second drive mechanism 450. In embodiments having first and second drive mechanisms 450 and/or two clutches, the method may further comprise timing the engagement and/or disengagement of the first drive mechanism 450 and/or clutches 454 such that the container blank 400 with the pleat 401 moves smoothly and continuously from the pleat forming station 300A into and through the feed wheels and into the mandrel station 500C. In such embodiments, the method may further comprise (i) engaging the clutch corresponding to the first drive mechanism, thereby driving the pusher arm(s) to apply pressure to the pleat 401 and push, move or propel the container wrap away from the pleat forming station 300A and towards the feed wheels at a speed slower than the speed of the feed wheels, and (ii) at a time when the container blank 400 approaches and/or contacts the feed wheels, disengaging the clutch corresponding to the first drive mechanism, thereby idling the first drive mechanism and causing the pusher arms to become stationary. In some embodiments comprising first and second drive mechanisms 450, the first and second drive mechanism 450 may, at times, be engaged and operate concurrently and, at times, be operated separately.

Forming the Container with a Reinforced Bottom

FIG. 5, FIGS. 6A-6B and FIGS. 7A-7E show views of exemplary mandrel stations 500C, 600C and 700C, respectively. The structures described with regard to each of the exemplary mandrel stations 500C, 600C and 700C may be the same as or different from the structures described in the other exemplary mandrel stations 500C, 600C and 700C, and may be the same as or different from the mandrel station 200C in FIG. 2, and the clutch and feed wheel sections 200B of FIG. 2 and 400B of FIGS. 4A-4C. Referring to FIG. 5, the container wrap with the pleat formed therein moves from the clutch and feed wheel section 500B to a mandrel station 500C (FIG. 5), where a mandrel, including a mandrel alignment mechanism (see, e.g., 730 of FIG. 7) and a compression mechanism (see, e.g., 733 of FIG. 7B) bend and/or shape the container blank 500 to form the container or box having a bottom panel reinforced by at least one pleat 501. As shown in FIG. 5, in exemplary embodiments, feed wheels 570/575 transfer the container wrap 500 with pleat 501 from the clutch and feed wheel section 500B to the mandrel station 500C, positioning the container wrap 500 and pleat 501 under mandrel 530. In embodiments having end panels separate from the container wrap 500, a first end panel 518 with a slit 519 to receive the pleat 501 and a second end panel (not shown) on the opposite side of the mandrel 530, are positioned on the mandrel 530 prior to container wrap 500 with the pleat 501 entering the mandrel station 500C. In some implementations, the mandrel 530 may be moved and/or positioned by one or more cylinders, which may be hydraulically and/or pneumatically operated. Alternatively, the mandrel 530 may be moved and/or positioned by one or more motors and/or servo motors.

Referring now to FIGS. 6A-6C, one exemplary method comprises pushing, moving and/or propelling a plurality of end panels 618 to be placed onto the container blank 600 and/or the pleat 601 toward the mandrel 630 by the operating a belt 642 on each of a pair of head hopper conveyors 640 on opposing sides of the mandrel 630. In such exemplary embodiments, the method may include driving the belt 642 around a roller 643 (or a roller on the mandrel end of the conveyor; not shown), by operating a motor (also not shown). In some variations, instead of driving a belt, the end panels 618 may be moved toward the mandrel 630 by operating one or more spring and lock mechanisms, tension rods, pistons, cylinders, rack and pinion gear drives, or any other mechanism suitable for moving stacked objects forward.

As shown in FIG. 6A, the method may comprise holding an end panels 618 closest to the mandrel on the mandrel 630 using one or more spring fingers 634 on both sides of the mandrel 630, and releasing the end panel 618 closest to the mandrel 630 by moving a plurality of picks 635 attached to the mandrel 630 such that only one end panel 618 on each side of the mandrel 630 contacts the container blank 600 and/or the pleat (not shown). In exemplary embodiments, the mandrel 630 moves toward the container blank as the plurality of picks 635 push a single end panel 618 on each side of the mandrel 630 toward the pleat of the container blank or wrap 600. The spring fingers 634 and picks 635 are described in detail herein with regard to an exemplary apparatus (see the section entitled "Exemplary Mandrel Stations").

Referring now to the exemplary mandrel station 700C in FIGS. 7A-7E, after the end panels 718 are moved towards the mandrel 730 and the end panels 718 are held in place against the mandrel 730, the method comprises lowering the mandrel 730 from an initial position inside of the mandrel (see, e.g., FIG. 7A) and/or engaging a mandrel alignment mechanism 731, which may include a pair of alignment or alignment blocks 732 (see FIG. 7B) to a position that is above and/or near the pleat 701 (see, e.g., FIG. 7B). In exemplary embodiments, the method may include operating the alignment mechanism 731 to align the pleat 701 with the mandrel 730 by operating one or more hydraulic and/or pneumatic cylinders, motors, and/or servo motors, or any other method or machine known in the art capable of operating such alignment mechanism.

Referring now to FIG. 7C, the method further comprises aligning the pleat 701 with the slit 719 in the end panel 718. This may, in one embodiment, include moving the alignment blocks 732 attached to the mandrel alignment mechanism 731 from an initial alignment position toward the pleat 701 to a second alignment position, and contacting, clamping and/or pushing the alignment blocks 732 against the pleat 701, thereby aligning the container wrap 700 in the mandrel station 700C and/or the pleat 701 with the slit 719. In one embodiment, the method may comprise moving the alignment blocks 732 toward the pleat 701 with a piston mechanism 735 (FIG. 7C) until the alignment blocks contact the pleat 701 and align the container blank 700 with the end panel(s) 718 on the mandrel 730. Such a piston mechanism 735 may be operated using any method or device described herein (e.g., hydraulic cylinders, pneumatic cylinders, motors, etc.).

Referring now to FIG. 7D, after the alignment mechanism 731 aligns the container blank with the end panel(s) 718, the method comprises (i) moving the mandrel 730 toward the container wrap 700 and pleat 701, and (ii) inserting the pleat 701 into slits 719 in the end panels 718. In some implementations, moving the mandrel 730 may comprise driving one or more hydraulic and/or pneumatic cylinders, motors, and/or servo motors, or any other mechanism known in the art capable of driving the mandrel 730.

In some embodiments, the alignment blocks 732 remain in contact with the pleat 701 until the end panels 718 are placed over the pleat 701 and/or the ends of the pleat 701 are inserted into the slits 719. In such embodiments, the method may include returning the alignment mechanism 731 to the initial position (see FIG. 7A) while the mandrel 730 moves toward the container blank 700 and before the mandrel 730 moves into the compression mechanism. In some embodiments, the alignment blocks 732 remain in contact with the pleat 701 as the mandrel 730 travels into the compression mechanism 733, as described herein with regard to FIG. 7E. In these embodiments, the method comprises returning the alignment blocks 732 to the initial alignment block position after the container 900 (see FIG. 7E) is fully formed.

As shown in FIG. 7E, as the mandrel 730 continues to travel into the compression mechanism 733, the method further comprises forcing the wrap 700 around the mandrel 730 and forming a fully formed container 900. Specifically, the compression mechanism 733 effectively forces the container wrap 700 around the mandrel 730, thereby bending, folding, or otherwise forming the container or box.

FIG. 8 shows an exemplary compression mechanism 833. The structures described herein with regard to the exemplary compression mechanism 833 may be the same as or different from the structures of the mandrel station 500C of FIG. 5, 600C of FIGS. 6A-6B and 700C of FIGS. 7A-7E. Referring now to FIG. 8, the compression mechanism 833 includes a plurality of forming shoes 837*a-d* attached to a pair of compression plates 836*a-b*. As the mandrel 830 moves into the compression mechanism 833 and past the forming shoes 837*a-d*, the method comprises folding the container wrap 800 with the pleat (not shown) to form sidewalls approximately perpendicular to the end panels (e.g., end panels 718 in FIGS. 7A-7D. In exemplary embodiments, the forming shoes 837*a-b* may be curved to create a smooth container-forming action. As indicated by the arrows in FIG. 8, after the sidewalls are formed, the method may also comprise moving compression plates 836*a-b* inward toward the mandrel 830, thereby folding end flaps attached to the sidewalls onto the end panels, and compressing the fully formed container 800. In exemplary embodiments, the method may further comprise driving the compression plates 836*a-b* by a plurality of hydraulic and/or pneumatic cylinders, motors, servo motors, and/or any other mechanism known in the art capable of moving the compression plates. In yet further embodiments, the method may comprise removing the fully formed container from the mandrel station manually, or alternatively, automatically using conventional automated equipment (e.g., a roller conveyor, a belt conveyor, a robotic arm, etc.) and/or placing another container wrap in the pleat forming station. Alternatively, the method may comprise moving another container wrap into the pleat forming station while a first container wrap is still in the clutch and feed wheel section and/or the mandrel station.

In some embodiments, the method may further comprise applying an adhesive to the container wrap prior to the wrap (e.g., 700 in FIGS. 7A-7D) entering mandrel station or the compression mechanism 833. For example, in some embodiments, one or more glue guns and/or other adhesive application equipment (not shown in the figures) may apply glue and/or adhesive to the container wrap (e.g., as it moves from the pleat forming station to the mandrel station). In some embodiments, the method may further include applying an adhesive (e.g., glue and/or tape) to the container wrap while the container wrap is in or traveling to the mandrel station, prior to the container wrap being forced around the end panels. In yet other embodiments, an adhesive may be applied to the end panels before and/or after the end panels are placed over the pleat.

Exemplary Methods of Manufacturing an Apparatus and/or Equipment for Making a Container with a Reinforced Bottom Panel Still other embodiments of the present invention relate to methods of manufacturing an apparatus and/or equipment for making a container with a reinforced bottom panel with one or more pleats. The method generally comprises (1) constructing a pleat forming station by operably mounting at least one breaker bar and at least one pair of score breakers relative to a platform configured to receive and/or support a container blank having a first score line and a second pair of score lines, the breaker bar(s) and the pair(s) of score breakers configured to form one or more pleats in the container blank; (2) constructing a clutch and feed wheel section by operably mounting a drive mechanism to a drive support frame on or near the platform, the drive mechanism comprising one or more pusher arms configured to apply pressure to the pleat(s) and move the container blank away from the platform; and (3) constructing a mandrel station by assembling a mandrel by operably attaching a mandrel alignment mechanism to a mandrel support frame downstream of the platform and/or the drive mechanism, the mandrel configured to place the pleat(s) into one or more slits in a pair of opposing end panels and fold the container blank to form the container.

Referring to the pleat forming station 300A shown in FIGS. 3A-3D, in some embodiments, constructing the pleat forming station 300A may comprise attaching one or more breaker bars 310 to a mechanical arm 330 in the pleat forming station at an initial breaker bar position, as shown in FIG. 3A. The method also generally comprises attaching the one or more pairs of score breakers 320*a-b* to score breaker support arms 325*a-b* in the pleat forming station, in an initial score breaker position, as shown also in FIG. 3A. In exemplary embodiments, the method may comprise attaching a cam 350*a-b* to each of the breaker arms 325*a-b*, or alternatively forming a cam 350*a-b* in each breaker arm 325*a-b*. In such embodiments, the cams 350*a-b* may be associated with or attached to one or more hydraulic or pneumatic cylinders (360*a-b*), and/or motors. In addition, the method may further comprise forming cam tracks 355*a-b* along the length of each of the cams 350*a-b*. Such embodiments may further comprise attaching, affixing, or securing the cylinders 360*a-b* and/or motors of the cams 350*a-b* to cam followers 365 that are nested in the cam tracks 355. In some embodiments, the method may further comprise mounting cams 350*a-b* on a frame, affixing the frame to the platform 340, and mounting or attaching the cam followers 365*a-b* to breaker arms 325*a*-325*b*, to which the score breakers 320*a-b* are attached. In still further embodiments, the method may further comprise mounting an adhesive application mechanism to pleat forming station, such that the adhesive application mechanism applies adhesive to one or more surfaces of the pleat (e.g., in regions between the score lines), prior to forming and/or compressing the pleat.

Exemplary pleat forming stations 300A, and the various components thereof, are discussed in detail herein with regard to an exemplary apparatus (see the section entitled "Exemplary Pleat Forming Stations" above). Furthermore, the method of forming a pleat in a container blank with such a pleat forming station is described in detail herein with regard to exemplary methods of making a container with a reinforced bottom panel (see the section entitled "Forming the Pleat" above).

Referring now to FIGS. 4A-4D, constructing the clutch and feed wheel section 400B and operatively connecting the clutch and feed wheel section to the pleat station may comprise attaching a drive mechanism 450 to a support frame such that the drive mechanism 450 is connected to one or more gear assemblies. For example, in exemplary embodiments, a pair of first gear assemblies that drives one or more pusher arms 451 is attached and/or coupled to the drive mechanism 450, where the pusher arm(s) 451 is described above with regard to FIGS. 4A-4D. In addition, constructing the clutch and feed wheel section also comprises operably connecting the pair of first gear assemblies to a drive mechanism 450, which may in turn comprise securing one or more chains or belts around one or more first gears or pulleys 455*a*, one or more second gears or pulleys 455*b*, and optionally one or more tension gears or pulleys 455*c*. Such methods may further comprise attaching the pusher arm(s) 451 to the chains so that the pusher arm(s) 451 are engaged by the drive mechanism 450 and gear assembly 455*a-c*.

The method may further comprise attaching one or more pairs of feed wheels 470*a-c*/475*a-c* to a rotating shaft 458, such that the one or more pairs of feed wheels 470*a-c*/475*a-c* may (a) rotate in the direction of travel of the container wrap 400, (b) push, guide, and/or move the container wrap 400 from the feed wheels 470*a-c*/475*a-c* into a mandrel station (500A of FIG. 5), and (c) allow the pleat(s) 401 in the container wrap 400 to move through the one or more pairs of feed wheels 470*a-c*/475*a-c*. In exemplary embodiments, some of the feed wheels 470*a-c* are attached on the pleat side of the container and others of the feed wheels 475*a-c* are attached on the non-pleat side of the container, as shown in FIGS. 4A, 4B, and 4D. In such embodiments, the method may further comprise forming a cutout section 480 in the feed wheels 470*a-c* on the pleat side of the container, wherein the cutout section 480 misses the pleat and allows the pleat 401 in the container wrap 400 to move through and/or past the feed wheels 470*a-c*.

In some embodiments, the method may further comprise optimally connecting a drive mechanism (e.g., a motor, gearbox and/or and a clutch) to one or more of the feed wheels. For example, the method may further comprise connecting the rotating shaft to at least one feed wheel (e.g., 470*a*) in the feed wheel assembly. Exemplary clutch and feed wheel section 400B, and the various components thereof, are discussed in detail herein with regard to the exemplary apparatus (see the section entitled "Exemplary Clutch and Feed Wheel Sections" above). Furthermore, a method of transporting a container blank having a pleat using such a clutch and feed wheel section is described in detail herein with regard to exemplary methods of making a container with a reinforced bottom panel (see the section entitled "Transporting the Container Blank with the Pleat" above).

Referring now to the mandrel station 700C shown in FIGS. 7A-7E, constructing the mandrel station 700C may comprise operably attaching a mandrel 730 to a mandrel mount downstream of the clutch and feed wheel section (e.g., 200B in FIG. 2 or 400B in FIGS. 4A-4D) and/or the pleat forming station (e.g., 200A in FIG. 2 or 300A in FIGS. 3A-3D). In general, the mandrel 730 is attached so that the mandrel is configured to (a) move from an initial mandrel position (see FIG. 7A) to place, push and/or guide two opposing end panels 718 over the one or more pleats 701 in a container wrap 700 and capturing the ends of the pleat(s) 701 in one or more slits 719 in the opposing end panels 718, (b) plow and/or force the container wrap 700 into a compression mechanism (see, e.g., FIG. 8) and fold parts of the container wrap 700 around the end panels (e.g., 718 of FIGS. 7A-7D), thereby fully forming a container, and optimally (c) return to an initial mandrel position.

Referring back to FIGS. 6A-6B, in some embodiments, the method comprises attaching a pair of head hopper conveyors 640 to the mandrel 630, where each of the head hopper conveyors may be positioned on opposing sides of the mandrel 630. The head hopper conveyors 640 are configured to push, propel, or otherwise move a plurality of end panels 618 toward the mandrel. One or more spring fingers 634 may be attached to the conveyors 640 to help hold the end panels closest to the mandrel 630 against the mandrel 630 in a position to be pushed onto the container blank 600. In exemplary embodiments, the method further comprises attaching a plurality of picks 635 to the mandrel 630, configured to push the closest end panel 618 past and through spring fingers 634 and onto the pleats of the container blank 600 as the mandrel 630 moves toward the container blank 600.

Referring now to FIGS. 7A-7E, the method may further comprise attaching a mandrel alignment mechanism 731 to the mandrel 730 (FIG. 7A) and attaching one or more pairs of alignment blocks 732 to the alignment mechanism 731. In general, the mandrel alignment mechanism 731 is configured to align the pleat 701 in the container wrap 700 with a position of the slit 719 in the end panel 718 (shown in FIG. 7B). The alignment mechanism typically moves toward the pleat(s) 701 of the container wrap 700 such that the alignment blocks 732 contact, clamp onto and/or push against the pleat(s) 701, thereby positioning the wrap 700 in the center of the mandrel station and aligning the wrap 700 with end panels 718 positioned on opposite sides of the mandrel 700 (see FIG. 7C).

Referring now to FIG. 8, the method may comprise attaching the mandrel 830 to a compression mechanism 833 or vice versa. The compression mechanism 833 generally forces flaps and/or sidewalls in the container wrap 800 around the mandrel 830 and forms a completed container 800. To form the compression mechanism 833, each of a plurality of forming shoes 837*a-d* are attached to one of two compression plates 836*a-b* (e.g., via a bracket, hinge, and/or another attachment mechanism known in the art) so that each forming shoe 837*a-d* is approximately perpendicular (e.g., have a 90° angle) to the compression plate 836*a-b* to which it is attached. The compression plates 836*a-b* may be attached to or associated with a plurality of hydraulic and/or pneumatic cylinders, motors, servo motors, or any other mechanism known in the art, capable of driving the compression plates 836*a-b* inward toward the mandrel 830 and compressing the fully formed container 800.

In some embodiments, the method may further comprise mounting an adhesive application mechanism in and/or near the clutch and feed wheel section, to the mandrel, mandrel alignment mechanism and/or compression mechanism in a location and/or position that allows and/or enables the adhesive application mechanism to apply adhesive to the container wrap and/or end panels prior to the container wrap being folded, plowed and/or forced over the end panels.

Exemplary mandrel stations 700A, and the various components thereof, are discussed in detail herein with regard to an exemplary apparatus (see the section entitled "Exemplary Mandrel Stations" above). Furthermore, a method of folding a container with a reinforced bottom panel in the mandrel station is described in detail herein with regard to exemplary methods of making a container with a reinforced bottom panel (see the section entitled "Forming the Container with a Reinforced Bottom" above).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

CONCLUSION/SUMMARY

The present invention advantageously provides (1) apparatuses and/or equipment that automatically form containers with a reinforced (pleated) bottom panel, (2) methods of forming a container with a reinforced bottom panel, and (3)

methods of manufacturing an apparatus and/or equipment for making a container with a bottom panel reinforced with one or more pleats. The pleat(s) provide extra strength to the bottom panel of the container, thereby helping to reduce or eliminate bottom sag. The present invention advantageously provides a mechanical apparatus and/or mechanical equipment that is capable of automatically forming such pleated containers, while avoiding (1) damage to the containers and/or container blanks being folded, and (2) obstructions or instability in the containers that may result from inadvertent folding of the parts, pleats, flaps, and/or panels in the wrong or an inconsistent direction during the folding process. The apparatuses and methods described herein enable containers with reinforced bottom panels to be manufactured automatically, which is both efficient and cost-effective The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An apparatus for forming a container with a reinforced bottom panel, comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) a drive mechanism comprising one or more pusher arms, the pusher arms configured to apply pressure to the pleat(s) to move the container blank away from the platform;

e) a plurality of feed wheels, at least one first feed wheel positioned to contact a surface of the container blank containing the pleat, and at least one second feed wheel positioned to contact an opposing surface of the container blank, wherein the at least one first feed wheel comprises a cutout section configured to allow the pleat to move through and/or past the at least one first feed wheel; and f) a mandrel configured to mate the pleat(s) with one or more slits in each of a pair of opposing end panels of the container and/or place the pleat(s) into the slit(s).

2. The apparatus of claim 1, further comprising a compression mechanism configured to fold and/or compress sidewalls and/or attachment flaps of the container blank and form the container.

3. The apparatus of claim 2, wherein (i) the compression mechanism comprises one or more forming shoes attached to each of a pair of compression plates, (ii) each of the forming shoes forms approximately a 90° angle with the compression plate to which the forming shoe is attached, (iii) the forming shoes are configured to fold the container blank as the mandrel moves past the forming shoes and into the compression mechanism to form sidewalls approximately perpendicular to the end panels, and (iv) the compression plates are configured to move toward the mandrel and fold end flaps attached to the sidewalls onto the end panels.

4. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) a drive mechanism comprising one or more pusher arms, the pusher arms configured to apply pressure to the pleat(s) to move the container blank away from the platform;

e) at least one clutch and one or more gear assemblies coupled to the clutch, the clutch(es) configured to engage and/or disengage the pusher arm(s);

f) a rotating shaft coupled and/or connected to the drive mechanism configured to drive at least one of a plurality of feed wheels; and g) a mandrel configured to mate the pleat(s) with one or more slits in each of a pair of opposing end panels of the container and/or place the pleat(s) into the slit(s).

5. The apparatus of claim 4, further comprising the plurality of feed wheels, at least one first feed wheel positioned to contact a surface of the container blank containing the pleat, and at least one second feed wheel positioned to contact an opposing surface of the container blank, wherein the at least one first feed wheel comprises a cutout section configured to allow the pleat to move through and/or past the at least one first feed wheel.

6. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) at least one mechanical arm;

e) one or more first pneumatic cylinders, hydraulic cylinders, motors or servo-motors connected to the mechanical arm(s), wherein at least a first one of the breaker bar(s) is attached to the mechanical arm(s), and each breaker bar is configured to contact the container blank at a score line in the container blank corresponding to the first fold;

f) a drive mechanism comprising one or more pusher arms, the pusher arms configured to apply pressure to the pleat(s) to move the container blank away from the platform; and g) a mandrel configured to mate the pleat(s) with one or more slits in each of a pair of opposing end panels of the container and/or place the pleat(s) into the slit(s).

7. The apparatus of claim 6, further comprising a plurality of feed wheels, at least one first feed wheel positioned to contact a surface of the container blank containing the pleat, and at least one second feed wheel positioned to contact an opposing surface of the container blank, wherein the feed wheel(s) comprise a cutout section configured to allow the pleat to move through and/or past the feed wheel(s).

8. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) one or more cams, each cam attached to one of the score breakers and comprising a cam track and a cam follower nested and/or in contact with the cam track(s);

e) one or more breaker arms attached to the cam(s);

f) one or more pneumatic cylinders, hydraulic cylinders, motors or servo motors connected to the breaker arm(s), wherein the cam is configured to control and/or guide the movement of a corresponding score breaker to form the second fold;

g) a drive mechanism comprising one or more pusher arms, the pusher arms configured to apply pressure to the pleat(s) to move the container blank away from the platform; and h) a mandrel configured to mate the pleat(s) with one or more slits in each of a pair of opposing end panels of the container and/or place the pleat(s) into the slit(s).

9. The apparatus of claim 8, further comprising (i) at least one clutch and one or more gear assemblies coupled to the clutch, the clutch(es) configured to engage and/or disengage the pusher arm(s), and (ii) a rotating shaft coupled and/or connected to the drive mechanism configured to drive at least one of a plurality of feed wheels.

10. The apparatus of claim 8, further comprising (i) at least one mechanical arm, and (ii) one or more first pneumatic cylinders, hydraulic cylinders, motors or servo-motors connected to the mechanical arm(s), wherein at least a first one of the breaker bar(s) is attached to the mechanical arm(s), and each breaker bar is configured to contact the container blank at a score line in the container blank corresponding to the first fold.

11. The apparatus of claim 8, further comprising a plurality of feed wheels, at least one first feed wheel positioned to contact a surface of the container blank containing the pleat, and at least one second feed wheel positioned to contact an opposing surface of the container blank, wherein the at least one first feed wheel comprises a cutout section configured to allow the pleat to move through and/or past the at least one first feed wheel.

12. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) a drive mechanism comprising one or more pusher arms, the pusher arms configured to apply pressure to the pleat(s) to move the container blank away from the platform;

e) a mandrel configured to mate the pleat(s) with one or more slits in each of a pair of opposing end panels of the container and/or place the pleat(s) into the slit(s); and f) a pair of head hopper conveyors on opposing sides of the mandrel, wherein each head hopper conveyor is configured to move one or more end panels toward the mandrel.

13. The apparatus of claim 12, further comprising:

a) one or more spring fingers on opposing sides of the mandrel configured to (i) align the slit(s) in the end panels and the pleat(s), and (ii) hold the end panels against the mandrel until the pleats are in the slits; and b) a plurality of picks attached to opposing sides of the mandrel, wherein the picks are configured to push the end panels past and/or through the spring fingers and onto the container blank.

14. The apparatus of claim 12, further comprising a mandrel alignment mechanism configured to align the pleat(s) with the mandrel and/or the one or more slits in the opposing end panels, wherein (i) the alignment mechanism comprises at least one pair of alignment blocks positioned on opposing sides of the pleat(s), and (ii) each pair of alignment blocks is configured to move from an initial block position inside the mandrel to a second block position in which at least a portion of the alignment blocks contacts, clamps onto, and/or pushes against the pleat to align the container blank beneath and/or in relation to the mandrel.

15. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) a drive mechanism comprising one or more pusher arms, the pusher arms configured to apply pressure to the pleat(s) to move the container blank away from the platform;

e) a mandrel configured to mate the pleat(s) with one or more slits in each of a pair of opposing end panels of the container and/or place the pleat(s) into the slit(s);

f) one or more spring fingers on opposing sides of the mandrel configured to (i) align the slit(s) in the end panels and the pleat(s), and (ii) hold the end panels against the mandrel until the pleats are in the slits; and g) a plurality of picks attached to opposing sides of the mandrel, wherein the picks are configured to push the end panels past and/or through the spring fingers and onto the container blank.

16. An apparatus for forming a container with a reinforced bottom panel comprising:

a) at least one breaker bar, each breaker bar configured to form a first fold in a container blank;

b) at least one pair of score breakers, each score breaker configured to form a second fold in the container blank in a direction opposite to the first fold, and wherein the pair(s) of score breakers are configured to form one or more pleats from the container blank between the second folds;

c) a platform between the breaker bar(s) and the pair(s) of score breakers configured to receive and/or support the container blank, the platform having at least one gap and/or opening sufficient to allow the breaker bar(s) to pass through the platform and contact the container blank to form the pleat(s);

d) a drive mechanism comprising one or more pusher arms, the pusher arms configured to apply pressure to the pleat(s) to move the container blank away from the platform;

e) a mandrel configured to mate the pleat(s) with one or more slits in each of a pair of opposing end panels of the container and/or place the pleat(s) into the slit(s); and f) a mandrel alignment mechanism configured to align the pleat(s) with the mandrel and/or the one or more slits in the opposing end panels, wherein (i) the alignment mechanism comprises at least one pair of alignment blocks positioned on opposing sides of the pleat(s), and (ii) each pair of alignment blocks is configured to move from an initial block position inside the mandrel to a second block position in which at least a portion of the alignment blocks contacts, clamps onto, and/or pushes against the pleat to align the container blank beneath and/or in relation to the mandrel.

17. A method of manufacturing an apparatus for forming a container with a reinforced bottom panel, comprising:

a) operably mounting at least one breaker bar and at least one pair of score breakers relative to a platform configured to receive and/or support a container blank having a first score line and a second pair of score lines, the breaker bar(s) and the pair(s) of score breakers configured to form one or more pleats in the container blank;

b) operably mounting a drive mechanism to a drive support frame on or near the platform, the drive mechanism comprising one or more pusher arms configured to apply pressure to the pleat(s) and move the container blank away from the platform;

c) operatively connecting a clutch to the pusher arm(s) and at least one of a plurality of feed wheels, wherein at least a subset of the feed wheels have a cutout section configured to allow the pleat(s) to move through and/or past the feed wheels, such that when the clutch is engaged, the pusher arm(s) apply pressure to the pleat(s) and the feed wheels rotate to move the container blank towards a mandrel; and d) assembling the mandrel by operably attaching a mandrel alignment mechanism to a mandrel support frame downstream of the platform and/or the drive mechanism, the mandrel configured to place the pleat(s) into one or more slits in a pair of opposing end panels of the container and fold the container blank to form the container.

18. The method of claim 17, further comprising attaching a compression mechanism to the mandrel support frame.

19. The method of claim 18, further comprising:

a) attaching each of a pair of head hopper conveyors to opposing sides of the mandrel, wherein each head hopper conveyor is configured to move a plurality of end panels toward the mandrel;

b) attaching one or more spring fingers to each conveyor, wherein the spring fingers are configured to hold a nearest end panel against the mandrel;

c) attaching a plurality of picks to each of the opposing sides of the mandrel, wherein the picks are configured to push the nearest end panel past and through the spring finger(s) and toward the container blank;

d) attaching one or more alignment blocks to the mandrel alignment mechanism, wherein the alignment blocks are configured to contact the pleat(s), thereby aligning the container blank with the mandrel and/or the end panels on the opposing sides of the mandrel; and e) attaching a plurality of forming shoes and/or a pair of compression plates to the compression mechanism, wherein the forming shoes and the compression plates are configured to fold sidewalls and/or flaps in the container blank approximately perpendicular to and/or around the end panels to form the container.

20. The method of claim 17, further comprising:

a) attaching the at least one breaker bar to one or more mechanical arms;

b) operably attaching a first pneumatic cylinder, a first hydraulic cylinder, a first motor or a first servo-motor to at least one mechanical arm;

c) attaching one of (i) each score breaker or (ii) a breaker arm to a cam having a cam track formed therein;

d) connecting a cam follower to the other of a score breaker or a breaker arm; and e) placing and/or nesting each cam follower in each cam track;

f) operably attaching to each breaker arm a second pneumatic cylinder, a second hydraulic cylinder, a second motor or a second servo motor configured to move the cam follower within the cam track to control and/or guide the movement of the score breakers to form the pleat(s).

* * * * *